US007559133B2

(12) United States Patent
Chitty et al.

(10) Patent No.: US 7,559,133 B2
(45) Date of Patent: Jul. 14, 2009

(54) RIVETING SYSTEM

(75) Inventors: Eymard J Chitty, Easton, CT (US); Brian M Taylor, Glastonbury, CT (US); Peter C Thomas, Cheshire, CT (US); Daniel P Vigliotti, Hamden, CT (US)

(73) Assignee: Newfrey LLC, Newark, DE (US)

( * ) Notice: Subject to any disclaimer, the term of this patent is extended or adjusted under 35 U.S.C. 154(b) by 297 days.

(21) Appl. No.: 11/526,265

(22) Filed: Sep. 22, 2006

(65) Prior Publication Data

US 2007/0067986 A1 Mar. 29, 2007

Related U.S. Application Data

(63) Continuation of application No. PCT/US2005/009505, filed on Mar. 22, 2005.

(60) Provisional application No. 60/555,989, filed on Mar. 24, 2004, provisional application No. 60/567,576, filed on May 3, 2004, provisional application No. 60/587,971, filed on Jul. 14, 2004, provisional application No. 60/589,149, filed on Jul. 19, 2004, provisional application No. 60/612,772, filed on Sep. 24, 2004, provisional application No. 60/625,715, filed on Nov. 5, 2004.

(51) Int. Cl.
*B23P 21/00* (2006.01)

(52) U.S. Cl. ..... 29/716; 29/798; 29/702; 29/703; 29/709; 29/243.53; 29/407.01; 29/407.05; 72/21.1; 72/391.2; 227/2; 700/175; 73/760; 73/763; 73/774

(58) Field of Classification Search ..... 29/716, 29/720, 798, 407.01, 407.05, 702, 703, 709, 29/243.53, 243.54, 243.523, 243.524; 72/20.1, 72/21.1, 21.4, 391.2, 391.4, 391.6; 227/1, 227/2, 3, 4; 700/108, 109, 110, 175; 73/760, 73/763, 774
See application file for complete search history.

(56) References Cited

U.S. PATENT DOCUMENTS

| | | | | |
|---|---|---|---|---|
| 3,665,742 | A | 5/1972 | Felt et al. | |
| 6,276,050 | B1 * | 8/2001 | Mauer et al. | 29/716 |
| 6,502,008 | B2 * | 12/2002 | Maurer et al. | 700/175 |
| 6,951,052 | B2 * | 10/2005 | Clew | 29/525.06 |
| 7,024,270 | B2 * | 4/2006 | Mauer et al. | 700/175 |
| 7,032,296 | B2 * | 4/2006 | Zdravkovic et al. | 29/709 |
| 7,123,982 | B2 * | 10/2006 | Mauer et al. | 700/175 |
| 7,331,205 | B2 * | 2/2008 | Chitty et al. | 72/21.1 |
| 7,409,760 | B2 * | 8/2008 | Mauer et al. | 29/715 |
| 2001/0039718 | A1 | 11/2001 | Mauer et al. | |
| 2007/0056153 | A1 * | 3/2007 | Opper et al. | 29/432 |

FOREIGN PATENT DOCUMENTS

| | | |
|---|---|---|
| DE | 100 64 243 A1 | 7/2002 |
| EP | 0 738 550 A2 | 4/1996 |

(Continued)

*Primary Examiner*—Essama Omgba
(74) *Attorney, Agent, or Firm*—Harness, Dickey & Pierce, P.L.C.

(57) ABSTRACT

A riveting system is operable to join two or more workplaces with a rivet. In another aspect of the present invention, a self-piercing rivet is employed. Still another aspect of the present invention employs an electronic control unit and one or more sensors to determine a riveting characteristic and/or an actuator characteristic.

26 Claims, 26 Drawing Sheets

FOREIGN PATENT DOCUMENTS

| | | | |
|---|---|---|---|
| EP | 1 382 406 | A2 | 1/2004 |
| EP | 1 506 846 | A1 | 2/2005 |
| JP | 62-77146 | | 4/1987 |
| JP | 04169828 | A | 6/1992 |
| JP | 6-190489 | | 7/1994 |
| JP | 7-015135 | | 3/1995 |
| WO | WO 02/43898 | A2 | 6/2002 |
| WO | WO 03/000445 | A1 | 1/2003 |

* cited by examiner

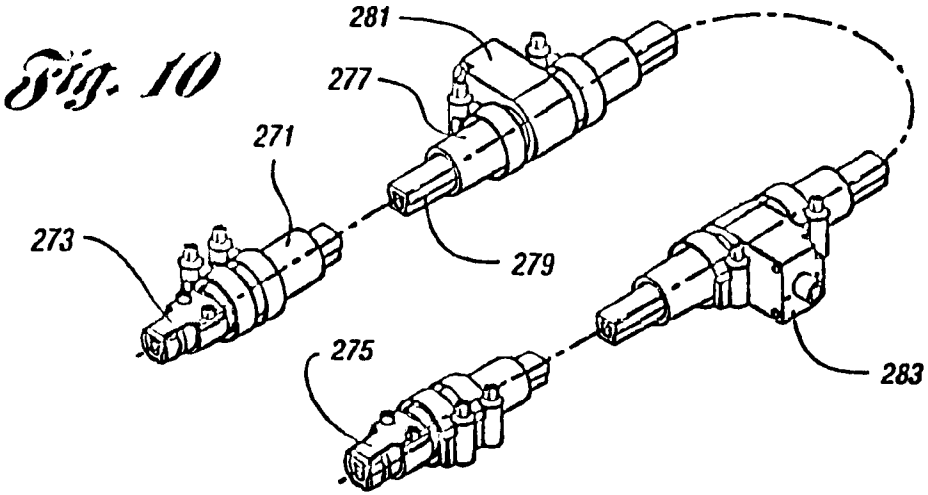
Fig. 10
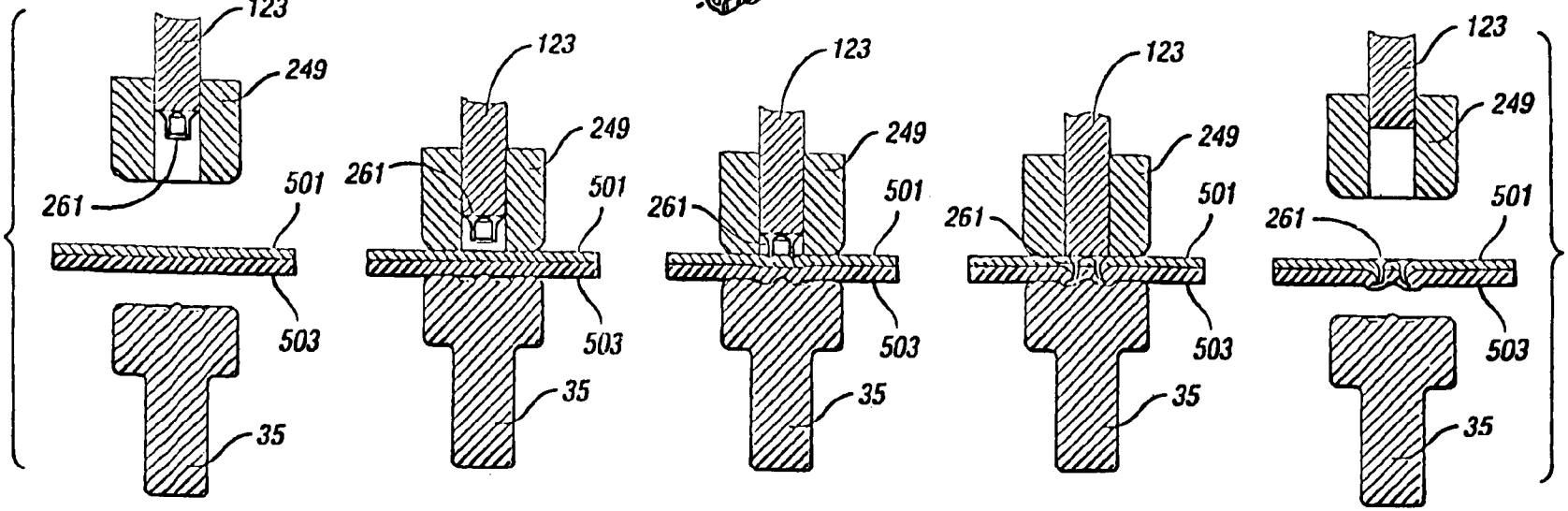
Fig. 13a
Fig. 13b
Fig. 13c
Fig. 13d
Fig. 13e

RIVETING SYSTEM

CROSS-REFERENCE TO RELATED APPLICATIONS

This application is a continuation of PCT International Application No. PCT/US2005/009505, filed Mar. 22, 2005, which claims the benefit of U.S. Provisional Applications Ser. No. 60/555,989 filed Mar. 24, 2004, Ser. No. 60/567,576 filed May 3, 2004, Ser. No. 60/587,971 filed Jul. 14, 2004, Ser. No. 60/589,149 filed Jul. 19, 2004, Ser. No. 60/612,772 filed Sep. 24, 2004, and Ser. No. 60/625,715 filed Nov. 5, 2004. The disclosures of the above applications are incorporated herein by reference.

FIELD OF THE INVENTION

This invention relates generally to riveting and more particularly to a riveting system and a process for forming a riveted joint.

BACKGROUND OF THE INVENTION

It is well known to join two or more sheets of metal with a rivet. It is also known to use self-piercing rivets that do not require a pre-punched hole. Such self-piercing or punch rivet connections can be made using a solid rivet or a hollow rivet.

A punch rivet connection is conventionally formed with a solid rivet by placing the parts to be joined on a die. The parts to be joined are clamped between a hollow clamp and the die. A plunger punches the rivet through the workpieces such that the rivet punches a hole in the parts thereby rendering pre-punching unnecessary. Once the rivet has penetrated the parts to be joined, the clamp presses the parts against the die, which includes a ferrule. The force of the clamp and the geometry of the die result in plastic deformation of the die-side part to be joined thereby causing the deformed part to partially flow into an annular groove in the punch rivet. This solid rivet is not deformed.

Traditionally, hydraulically operated joining devices are used to form such punch rivet connections. More specifically, the punching plunger is actuated by a hydraulic cylinder unit. The cost of producing such joining devices is relatively high and process controls for achieving high quality punch rivet connections has been found to be problematic. In particular, hydraulically operated joining devices are subject to variations in the force exerted by the plunger owing to changes in viscosity. Such viscosity changes of the hydraulic medium are substantially dependent on temperature. A further drawback of hydraulically operated joining devices is that the hydraulic medium, often oil, has a hydroscopic effect thereby requiring exchange of the hydraulic fluid at predetermined time intervals. Moreover, many hydraulic systems are prone to hydraulic fluid leakage thereby creating a messy work environment in the manufacturing plant.

When forming a punch connection or joint with a hollow rivet, as well as a semi-hollow rivet, the plunger and punch cause the hollow rivet to penetrate the plunger-side part to be joined and partially penetrate into the die-side part to be joined. The die is designed to cause the die-side part and rivet to be deformed into a closing head. An example of such a joined device for forming a punch rivet connection with a hollow rivet is disclosed in DE 44 19 065 A1. Hydraulically operating joining devices are also used for producing a punch rivet connection with a hollow rivet.

Furthermore, rivet feeder units having rotary drums and escapement mechanisms have been traditionally used. Additionally, it is known to use linear slides to couple riveting tools to robots.

It is also known to employ a computer system for monitoring various characteristics of a blind rivet setting system. For example, reference should be made to U.S. Pat. No. 5,661,887 entitled "Blind Rivet Set Verification System and Method" which issued to Byrne et al. on Sep. 2, 1997, and U.S. Pat. No. 5,666,710 entitled "Blind Rivet Setting System and Method for Setting a Blind Rivet Then Verifying the Correctness of the Set" which issued to Weber et al. on Sep. 16, 1997. Both of these U.S. patents are incorporated by reference herein.

SUMMARY OF THE INVENTION

In accordance with the present invention, a riveting system is operable to join two or more workpieces with a rivet. In another aspect of the present invention, a self-piercing rivet is employed. A further aspect of the present invention uses a self-piercing rivet which does not fully penetrate the die-side workpiece in an acceptable joint. Still another aspect of the present invention employs an electronic control unit and one or more sensors to determine a riveting characteristic and/or an actuator characteristic. In still another aspect of the present invention, an electric motor is used to drive a nut and spindle drive transmission which converts rotary actuator motion to linear rivet setting motion. In yet another aspect of the present invention, multiple rivet feeders can selectively provide differing types of rivets to a single riveting tool. Unique software employed to control the riveting machine is also used in another aspect of the present invention. A method of operating a riveting system is also provided.

The riveting system of the present invention is advantageous over conventional devices in that the present invention employs a very compact and mechanically efficient rotational-to-linear motion drive transmission. Furthermore, the present invention advantageously employs an electric motor to actuate the riveting punch thereby providing higher accuracy, less spilled fluid mess, lower maintenance, less energy, lower noise and less temperature induced variations as compared to traditional hydraulic drive machines. Moreover, the electronic control system and software employed with the present invention riveting system ensure essentially real time quality control and monitoring of the rivet, riveted joint, workpiece characteristics, actuator power consumption and/or actuator power output characteristics, as well as collecting and comparing historical processing trends using the sensed data.

The riveting system and self-piercing hollow rivet employed therewith, advantageously provide a high quality and repeatable riveted joint that is essentially flush with the punch-side workpiece outer surface without completely piercing through the die-side workpiece. The real-time characteristics of the rivet, joint and workpieces and the rivet setting machine are used in an advantageous manner to ensure the desired quality of the final product.

To overcome the disadvantages of the prior art, a system is provided which has a micro-strain sensor which measures strains within a tool component. These measured strains are compared to a number of varying tolerance bands formed about an exemplary strain versus time curve or displacement data. Various techniques are provided to analyze the measured data with respect to the tolerance bands to determine if a particular rivet set is acceptable.

Furthermore, the performance characteristics may be easily varied or altered by training the set points using training techniques, depending upon the specific joint or workpiece to be worked upon, without requiring mechanical alterations in the machinery. Additional advantages and features of the present invention will become apparent from the following description and appended claims, taken in conjunction with the accompanying drawings.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 10 is a partially fragmented perspective view showing a rivet feed tube of the preferred embodiment riveting system;

FIGS. 13*a*-13*e* are a series of diagrammatic and enlarged views, similar to those of FIG. 12, showing the self-piercing riveting sequence of the preferred embodiment riveting system;

FIGS. 16 and 17 are graphs showing force versus distance riveting characteristics of the preferred embodiment riveting system;

FIGS. 18*a*-18*d* are software flow charts of the preferred embodiment riveting system;

DETAILED DESCRIPTION OF THE PREFERRED EMBODIMENTS

The following description of the preferred embodiments is merely exemplary in nature and is in no way intended to limit the invention, its application, or uses. Generally speaking, the system sets a fastener for joining parts. The system is configured to confirm the quality of the setting process and of the resultant set. The system uses a rivet setting machine having a first member configured to apply a setting force to a fastener to set the fastener. A coupling structure is provided which is configured to apply reaction forces to the first member in response to the setting force. A sensor is attached to the coupling structure for sensing changes in physical parameters within said coupling structure induced by the reaction forces.

The first member applies the setting force along an axis to a first side of the fastener and the setting force is resisted by a second member which applies a reaction force generally parallel to setting force. This reaction force is caused by elastic deformation in the coupling structure.

The sensor is configured to measure strain at a location which is a predetermined radial distance from the axis. As described below, the sensor is located at a location on the coupling or support structure which is susceptible to strains induced by moments caused by the reaction force. Because of its location, the sensor is capable of being calibrated to indicate changes in physical parameters that can be displayed in comparative terms. Further, because of its location, the sensor need not be calibrated after routine maintenance such as the changing of dies or punch components.

Figure 1:
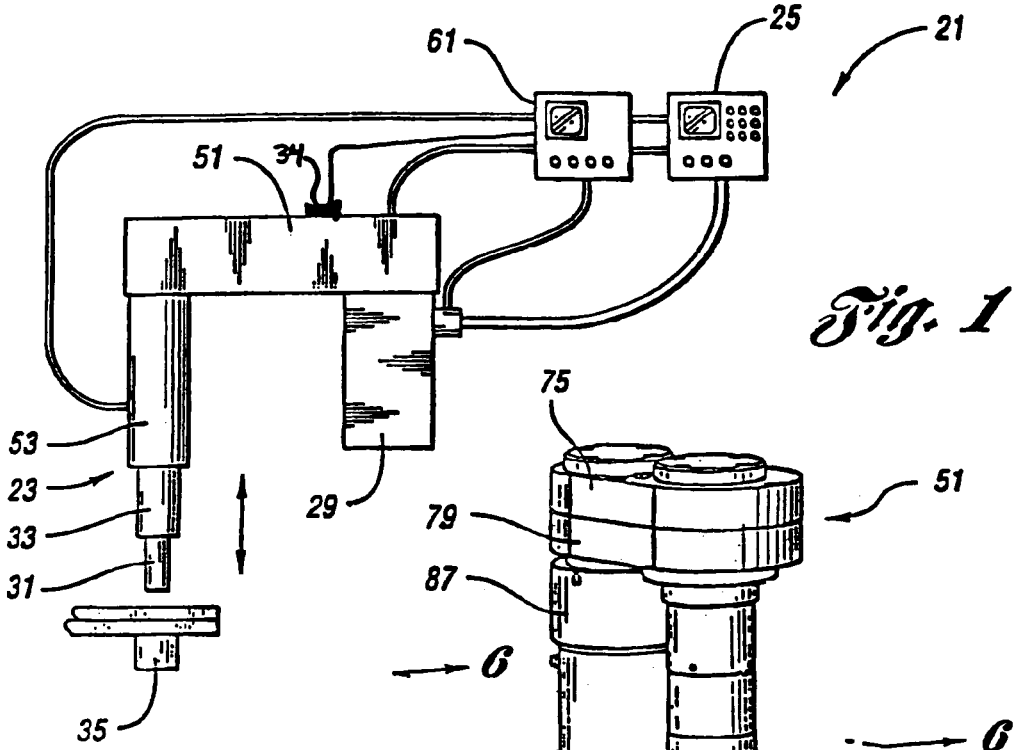
FIG. 1 is a diagrammatic view showing the preferred embodiment of the riveting system of the present invention.
Figure 2:
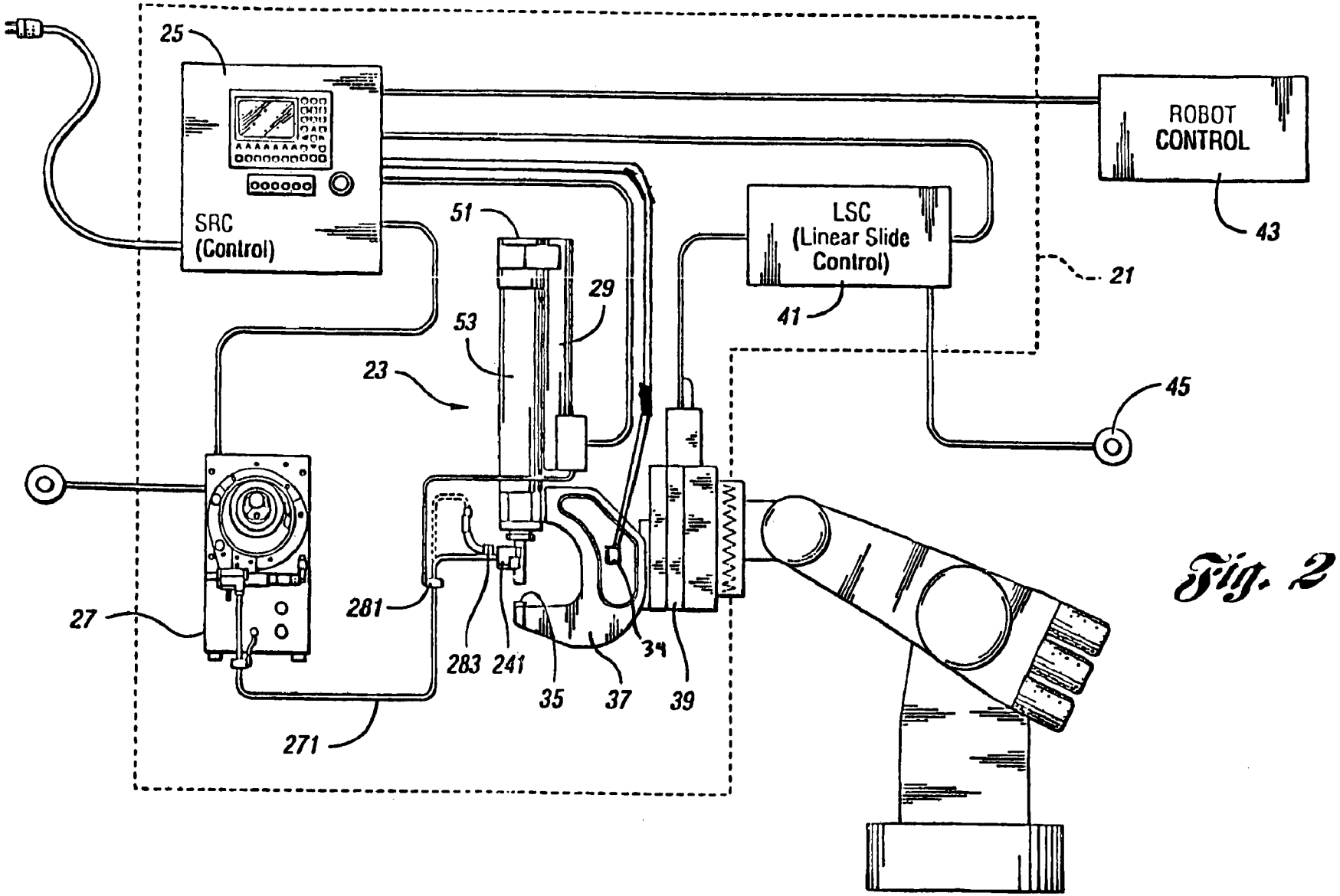
FIG. 2 is a partially diagrammatic, partially elevational view showing the preferred embodiment riveting system.

Referring to FIGS. 1 and 2, a joining device for punch rivets, hereinafter known as a riveting system 21, includes a riveting machine or tool 23, a main electronic control unit 25, a strain sensor 34, a rivet feeder 27, and the associated robotic tool movement mechanism and controls, if employed. Riveting tool 23 further has an a drive mechanism which can be either hydraulic or electric. The electric drive has an electric motor actuator 29, a transmission unit, a plunger 31, a clamp 33 and a die or anvil 35. The hydraulic drive utilizes hydraulic fluid driven by a fluid initiated piston. The fluid initiated piston can be driven by either hydraulic or pneumatic fluid. Die 35 is preferably attached to a c-shaped frame 37 or the like. Frame 37 also couples the advancing portion of riveting tool 23 to a set of linear slides 39 which are, in turn, coupled to an articulated robot mounted to a factory floor. A linear slide control unit 41 and an electronic robot control unit 43 are electrically connected to linear slides 39 and main electronic control unit 25, respectively. The slides 39 are actuated by a pneumatic or hydraulic pressure source 45.

The transmission unit of riveting tool 23 includes a reduction gear unit 51 and a spindle drive mechanism 53. Plunger 31, also known as a punch assembly, includes a punch holder and punch, as will be described in further detail hereinafter. A data monitoring unit may be part of the main controller 25, as shown in FIG. 2, or can be a separate microprocessing unit, as shown in FIG. 1, to assist in monitoring signals from the various sensors.

Figure 3A:
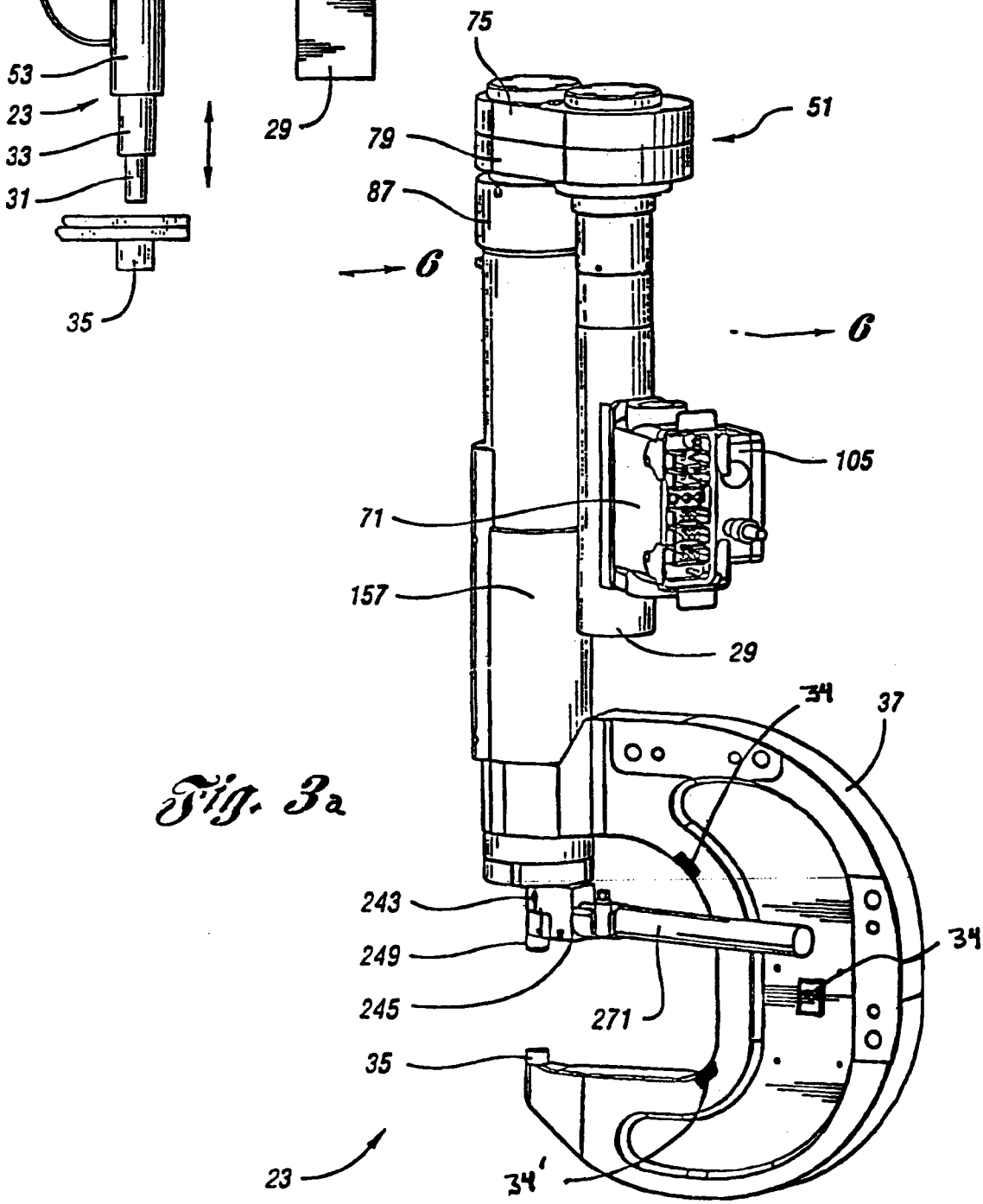
FIG. 3*a* is a perspective view showing a riveting tool of the preferred embodiment riveting system.
Figure 5:
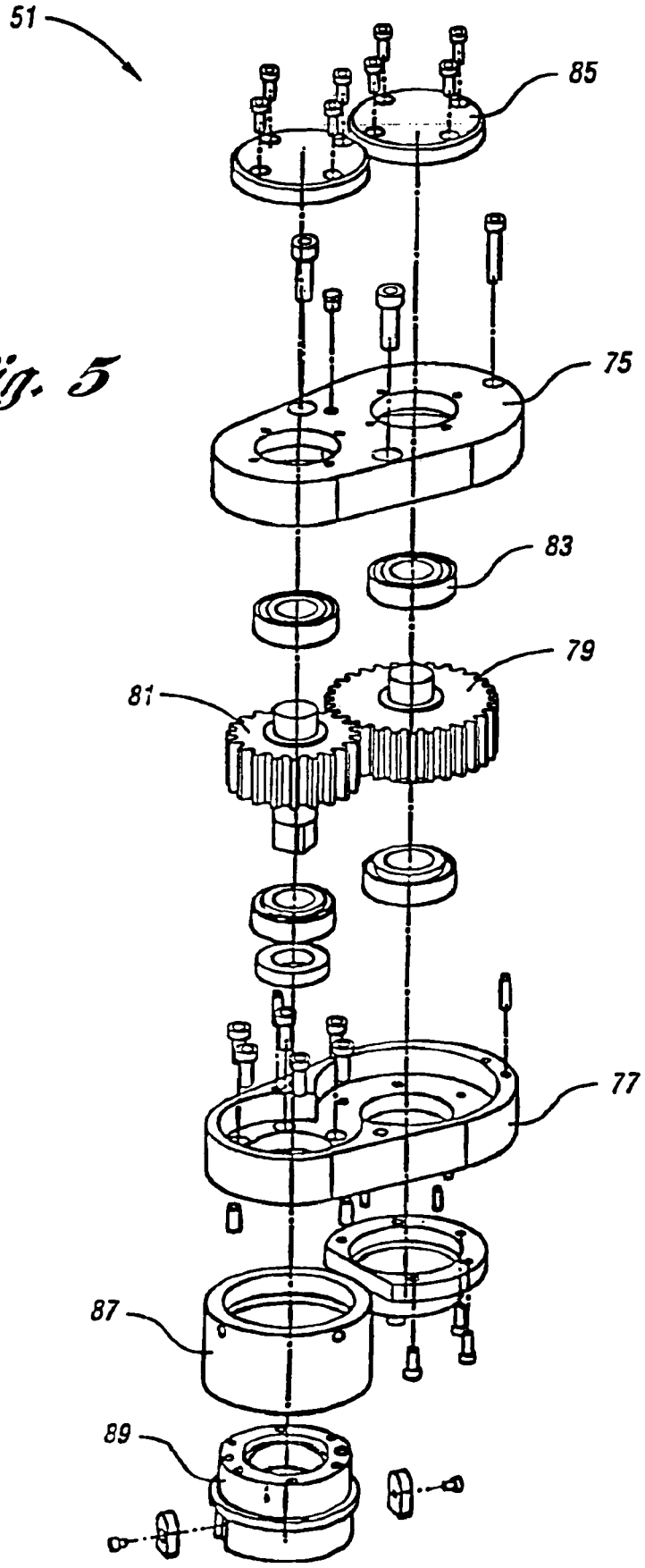
FIG. 5 is an exploded perspective view showing the gear reduction unit employed in the preferred embodiment riveting system.
Figure 6:
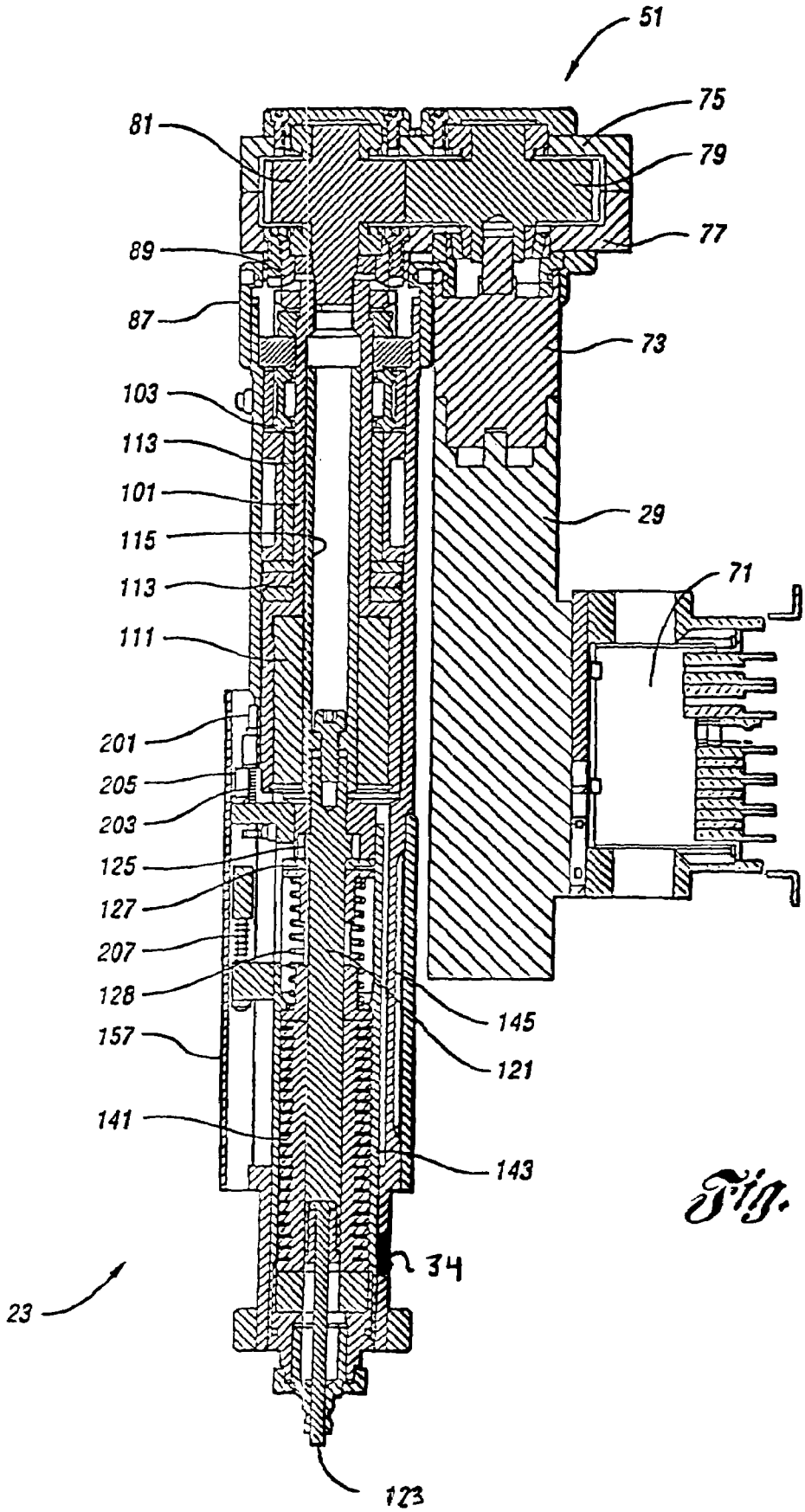
FIG. 6 is a cross sectional view, taken along line 6-6 of FIG. 3, showing the riveting tool of the preferred embodiment riveting system.

Reference is now made to FIGS. 3, 5 and 6. A main electrical connector 71 is electrically connected to main electronic control unit 25, which contains a microprocessor, a display screen, indicator lights, and input buttons. Connector 71 is also electrically connected to the strain sensor 34 and other proximity switch sensors located in riveting tool 23. Electric motor 29 is of a brushless, three phase alternating current type. Energization of electric motor 29 serves to rotate an armature shaft, which in turn, rotates an output gear 73. Electric motor 29 and gear 73 are disposed within one or more cylindrical outer casings.

Reduction gear unit 51 includes gear housings 75 and 77 within which are disposed two different diameter spur gears 79 and 81. Various other ball bearings 83 and washers are located within housings 75 and 77. Additionally, removable plates 85 are bolted onto housing 75 to allow for lubrication. Spur gear 79 is coaxially aligned and driven by output gear 73, thus causing rotation of spur gear 81. Adapters 87 and 89 are also stationarily mounted to housing 77.

Figure 3B:
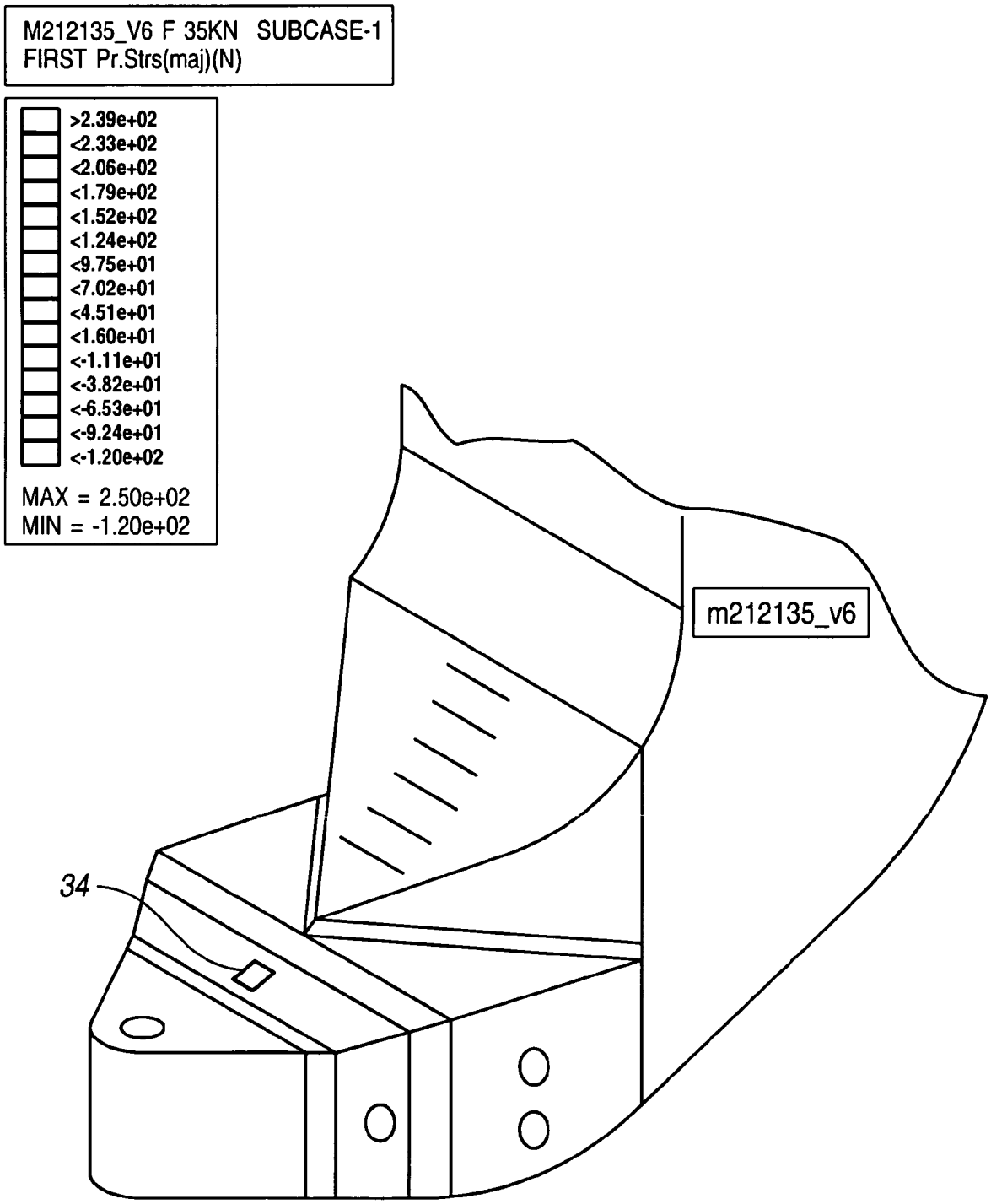
FIGS. 3*b* and 3*c* are perspective views of a support frame with associated strain according to the teachings of the present invention.
Figure 3C:
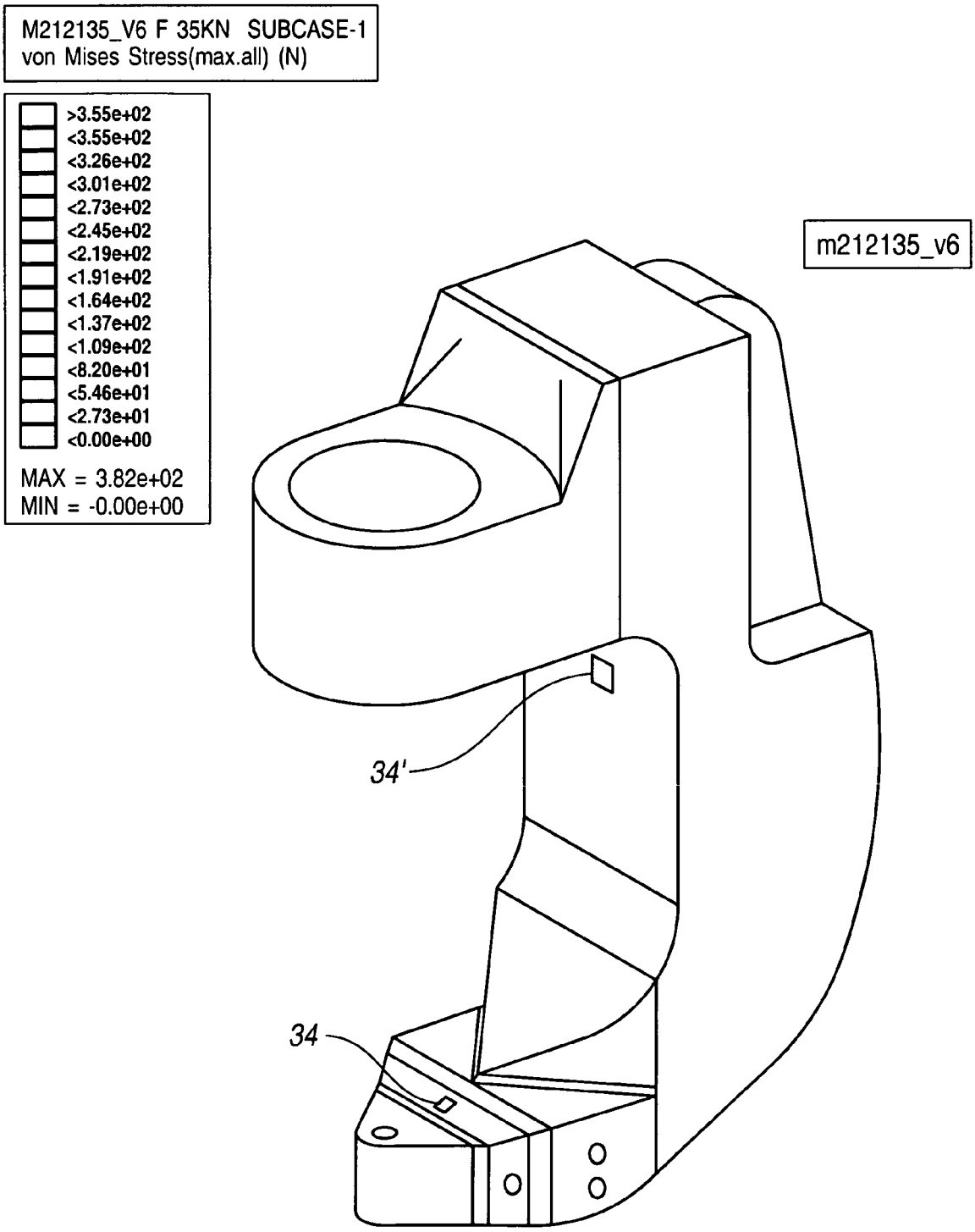

FIGS. 3*b* and 3*c* are perspective views of a support frame 37 with associated strain according to the teachings of the present invention. The support frame 37 has a sensor mounting location positioned at a location of the support frame 37 which undergoes measurable deformation during the rivet setting event. Shown is the strain analysis which indicates the locations of maximum strain caused by reaction forces or induced moments from the reaction forces during a rivet setting event. These locations are indicative preferred locations for the rivet sensor mounting locations.

Figure 4:
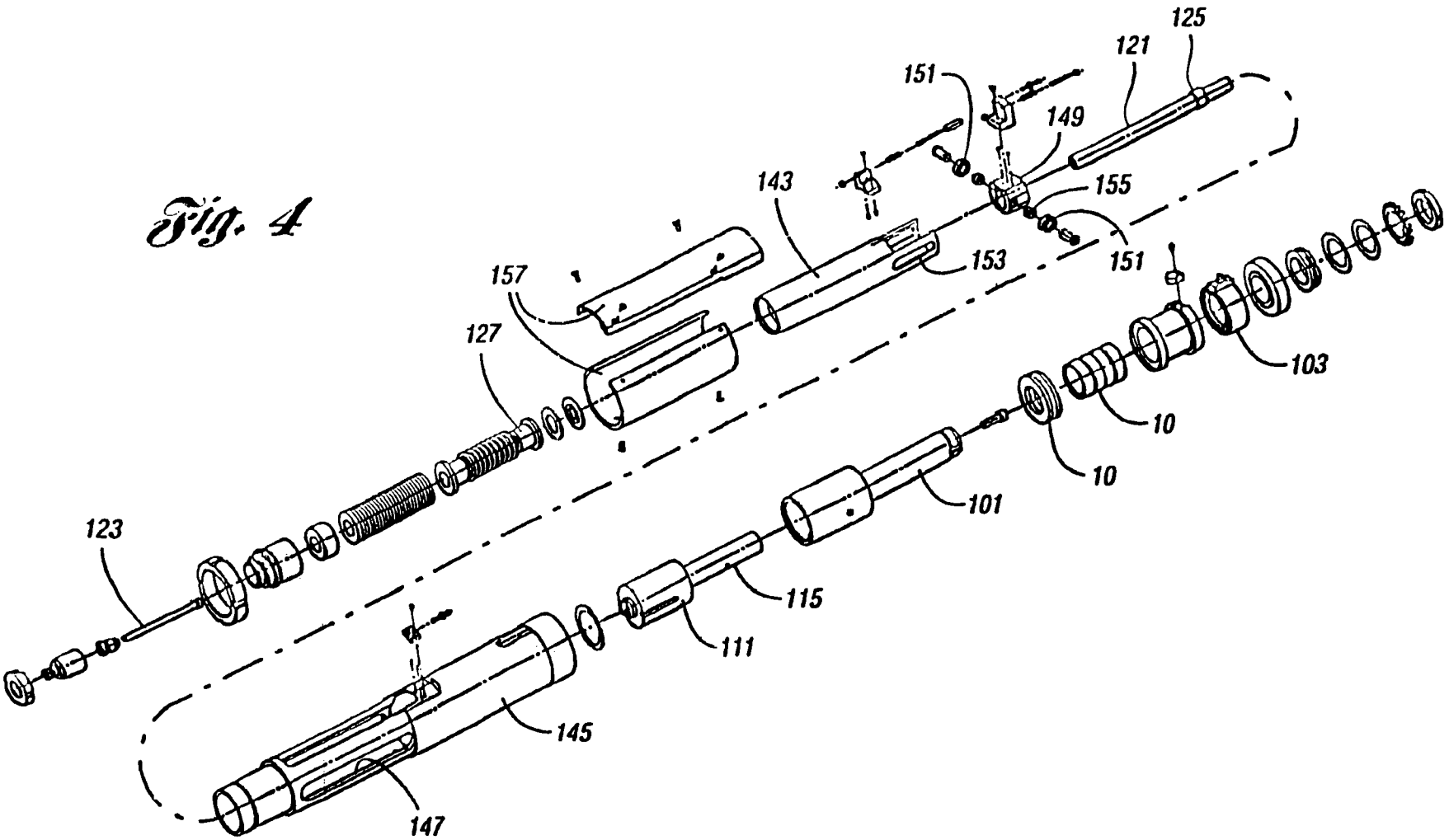
FIG. 4 is an exploded perspective view showing the nut and spindle mechanism, punch assembly, and clamp of the preferred embodiment riveting system.

FIGS. 4 and 6 show a nut housing 101 directly connected to a central shaft of spur gear 81. Therefore, rotation of spur gear 81 causes a concurrent rotation of nut housing 101. Nut housing 101 is configured with a hollow and generally cylindrical proximal segment and a generally enlarged, cylindrical distal segment. A load cell 103 is concentrically positioned around proximal segment of nut housing 101. Load cell 103 is electrically connected to a load cell interface 105 (see FIG. 3) which, in turn, is electrically connected to monitoring unit 61 (see FIG. 1). Sensor interface 105 is an interactive current amplifier. Load cell 103 is preferably a DMS load cell having a direct current bridge wherein the mechanical input force causes a change in resistance which generates a signal. Alternately, the load cell may be of a piezo-electric type.

A rotatable nut 111, also known as a ball, is directly received and coupled with a distal segment of nut housing 101 such that rotation of nut housing 101 causes a simultaneously corresponding rotation of nut 111. Ball bearings 113 are disposed around nut housing 101. A spindle 115 has a set of external threads which are enmeshed with a set of internal threads of nut 111. Hence, rotation of nut 111 causes linear advancing and retracting movement of spindle 115 along a longitudinal axis. A proximal end of a rod-like punch holder 121 is bolted to an end of spindle 115 for corresponding linear translation along the longitudinal axis. A rod-like punch 123 is longitudinally and coaxially fastened to a distal end of punch holder 121 for simultaneous movement therewith.

An outwardly flanged section 125 of punch holder 121 abuts against a spring cup 127. This causes compression of a relatively soft compression spring 128 (approximately 100-300 newtons of biasing force), which serves to drive a rivet out of the receiver and into an initial loaded position for engagement by a distal end of punch 123. A stronger compression spring 141 (approximately 8,000-15,000 newtons of biasing force) is subsequently compressed by the advancing movement of punch holder 121. The biasing action of strong compression spring 141 serves to later return and retract a clamp assembly, including a clamp 143 and nose piece, back toward gear reduction unit 51 and away from the workpieces.

A main housing 145 has a proximal hollow and cylindrical segment for receiving the nut and spindle assembly. Main housing 145 further has a pair of longitudinally elongated slots 147. A sleeve 149 is firmly secured to punch holder 121 and has transversely extending sets of rollers 151 or other such structures bolted thereto. Rollers 151 ride within slots 147 of main housing 145. Longitudinally elongated slots 153 of clamp 143 engage bushings 155 also bolted to sleeve 149. Thus, rollers 151 and slots 147 of main housing 145 serves to maintain the desired linear alignment of both punch holder 121 and clamp 143, as well as predominantly prevent rotation of these members. Additional external covers 157 are also provided. All of the moving parts are preferably made from steel.

Figure 15:
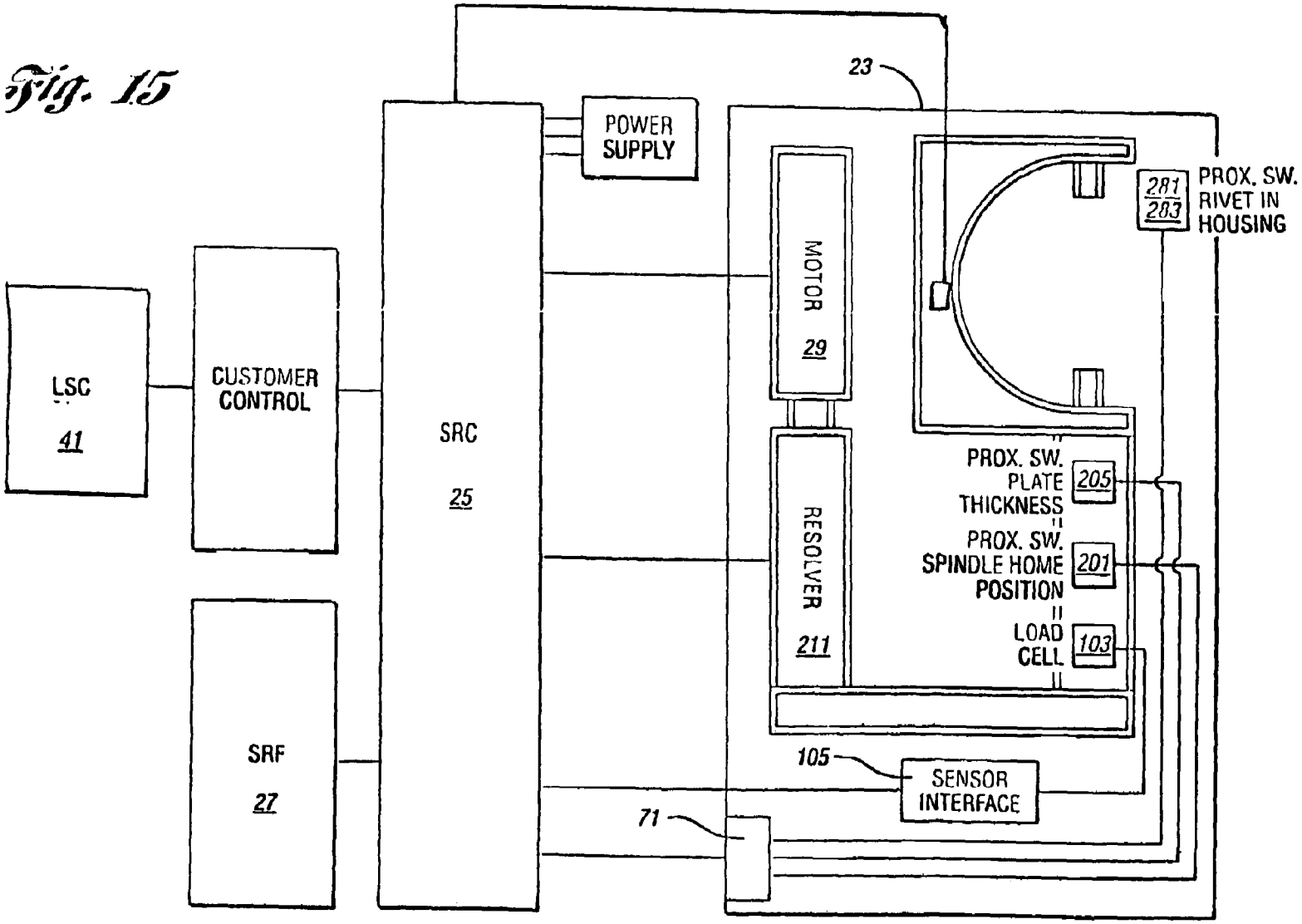

Referring to FIGS. 6 and 15, strain sensor 34 can be positioned either on the C-shaped support frame or within the nose housing of the punch. Spindle position proximity switch sensor 201 is mounted within riveting tool 23. A spring biased upper die and self-locking nut assembly 203 serves to actuate spindle position proximity switch 201 upon the spindle assembly reaching the fully retracted, home position. A plate thickness proximity switch sensor 205 is also mounted within riveting tool 23. An upper die type thickness measurement actuator and self-locking nut assembly 207 indicate the positioning of clamp 143 and thereby serve to actuate proximity sensor 205. Additional proximity switch sensors 281 and 283 are located in a feed tube for indicating the presence of a rivet therein in a position acceptable for subsequent insertion into the receiver of riveting tool 23. These proximity switches 201, 205, 281 and 283 are all electrically connected to main electronic control unit 25 via module 601. Furthermore, a resolver-type sensor 211 is connected to electric motor 29 or a member rotated therewith. Resolver 211 serves to sense actuator torque, actuator speed and/or transmission torque. The signal is then sent by the resolver to main electronic control unit 25. An additional sensor (not shown) connected to electric motor 29 is operable to sense and indicate power consumption or other electrical characteristics of the motor which indicate the performance characteristics of the motor; such a sensed reading is then sent to main electronic control unit 25.

Figure 7:
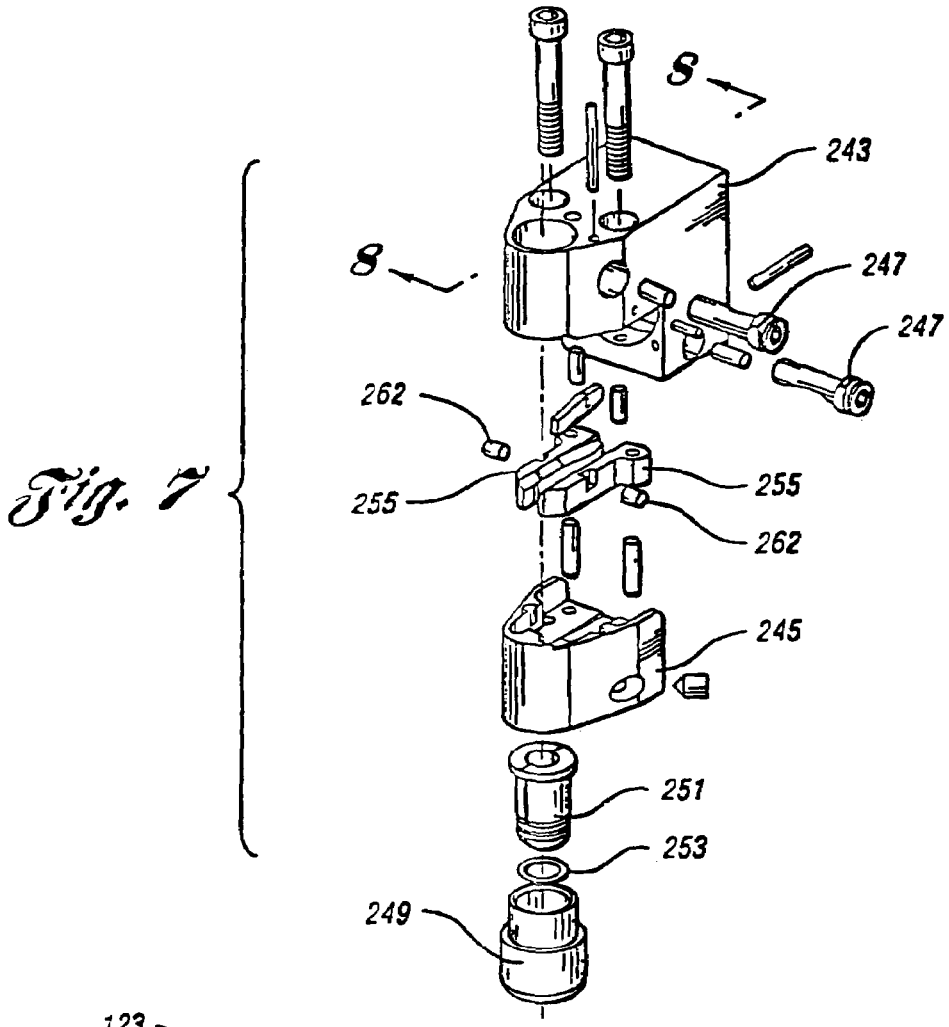
FIG. 7 is an exploded perspective view showing a receiving head of the preferred embodiment riveting system.
Figure 8:
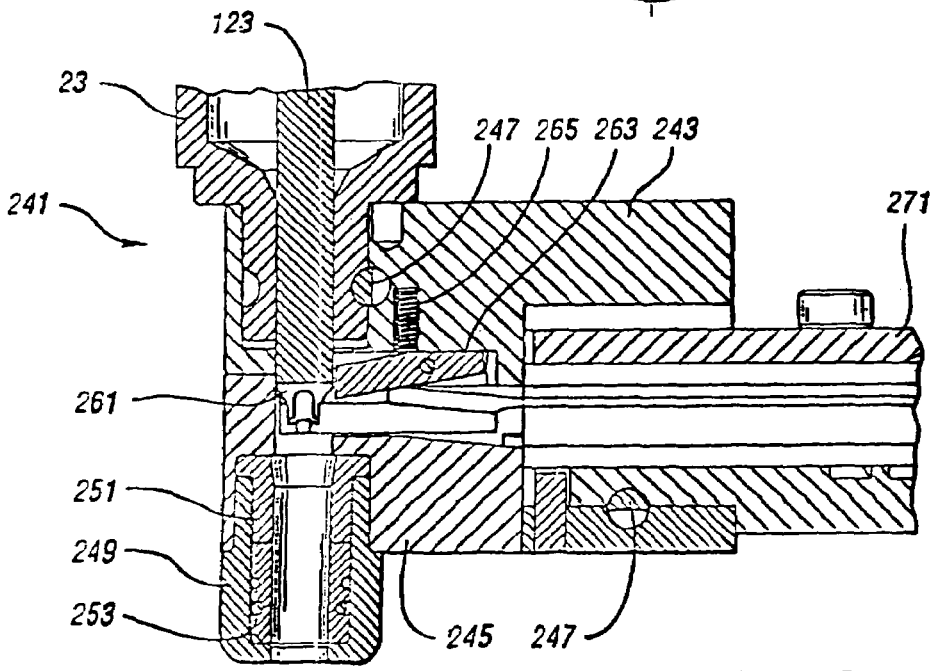
FIG. 8 is a cross sectional view showing the receiving head of the preferred embodiment riveting system.

FIGS. 7 and 8 best illustrate a receiver 241 attached to a distal end or head of riveting tool 23 adjacent punch 123. An upper housing 243 is affixed to a lower housing 245 by way of a pair of quick disconnect fasteners 247. A nose piece portion 249 of the clamp assembly is screwed into lower housing 245 and serves to retain a slotted feed channel 251, compressibly held by elastomeric 0-ring 253. A pair of flexible fingers 255 pivot relative to housings 243 and 245, and act to temporarily locate a rivet 261 in a desired position aligned with punch 123 prior to insertion into the workpieces. Compression springs 262 serve to inwardly bias flexible fingers 255 toward the advancing axis of punch 123. Furthermore, a catch stop 263 is mounted to upper housing 243 by a pivot pin. Catch stop 263 is downwardly biased from upper housing 243 by way of a compression spring 265. A suitable receiver is disclosed in EPO patent publication No. 09 22 538 A2 (which corresponds to German Application No. 297 19 744.4).

FIG. 10 illustrates a feed tube 271 having end connectors 273 and 275. End connector 273 is secured to receiver 241, (see FIG. 8) and connector end 275 is secured to feeder 27 (see FIG. 2). Feed tube 271 further includes a cylindrical outer protective tube 277 and an inner rivet carrying tube 279. Inner tube 279 has a T-shaped inside profile corresponding to an outside shape of the rivet fed therethrough. Feed tube 271 is semi-flexible. Entry and exit proximity switch sensors 281 and 283, respectively, monitor the passage of each rivet through feed tube 271 and send the appropriate indicating signal to main electronic control unit 25 (see FIGS. 2 and 15). The rivets are pneumatically supplied from feeder 27 to receiver 241 through feed tube 271.

Figure 11:
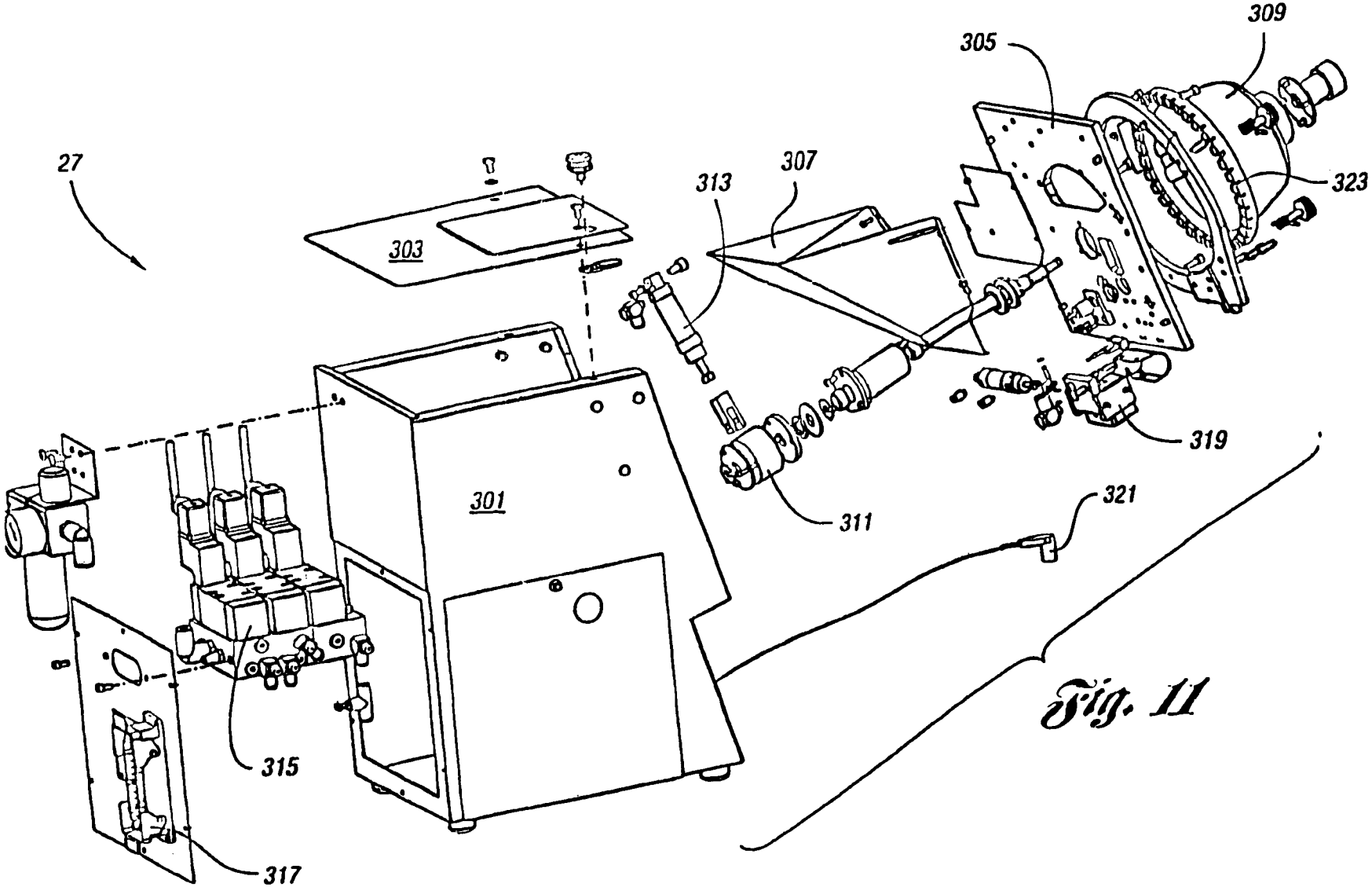
FIG. 11 is an exploded perspective view showing a feeder of the preferred embodiment riveting system.

FIG. 11 shows the internal construction of SRF feeder 27. The feeder has a stamped metal casing 301, upper cover 303 and face plate 305. Feeder 27 is intended to be stationarily mounted to the factory floor. A storage bunker 307 is attached to an internal surface of face plate 305 and serves to retain the rivets prior to feeding. A rotary bowl or drum 309 is externally mounted to face plate 305. It is rotated by way of a rotary drive unit 311 and the associated shafts. A pneumatic cylinder 313 actuates drive unit 311 and is controlled by a set of pneumatic valves 315 internally disposed within casing 301. An electrical connector 317 and the associated wire electrically connects feeder 27 to main electronic control unit 25 by way of module 601 (see FIGS. 2, 14 and 15).

A pneumatically driven, sliding escapement mechanism 319 is mounted to face plate 305 and is accessible to drum 309. A proximity switch sensor 321 is mounted to escapement mechanism 319 for indicating passage of each rivet from escapement mechanism 319. Proximity switch 321 sends the appropriate signal to the main electronic control unit through module 601. Rotation of drum 309 causes rivets to pass through a slotted raceway 323 for feeding into escapement 319 which aligns the rivets and sends them into feed tube 271 (see FIG. 10).

Figure 9:
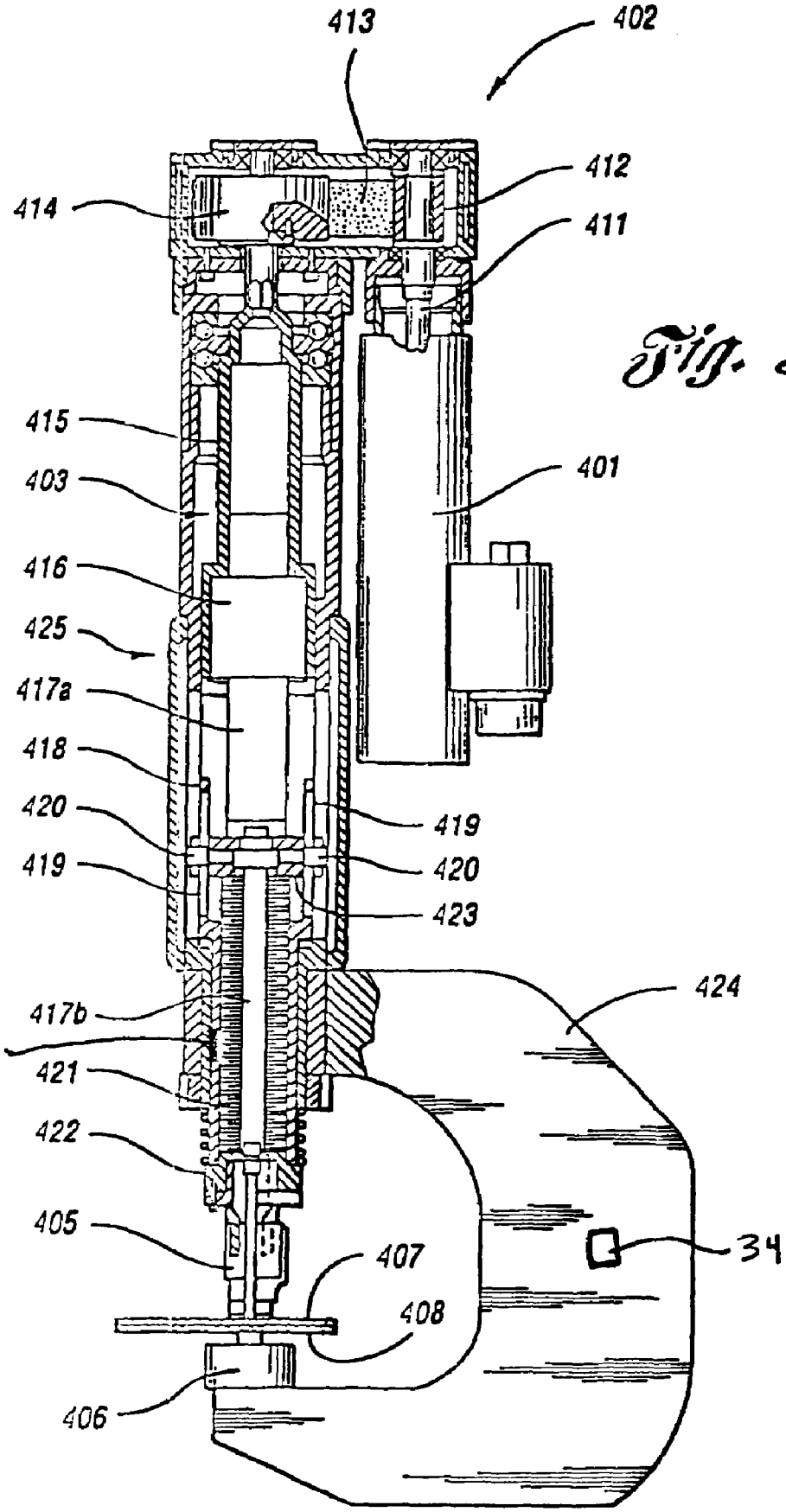
FIG. 9 is a cross sectional view, similar to FIG. 6, showing a first alternate embodiment of the riveting system.

FIG. 9 shows a first alternate embodiment riveting system. The joining device or riveting tool has an electric motor operated drive unit 401. Drive unit 401 is connected to a transmission unit 402 which is arranged in an upper end region of a housing 425. Housing 425 is connected to a framework 424.

A drive shaft 411 of drive unit 401 is connected to a belt wheel 412 of transmission unit 402. Belt wheel 412 drives a belt wheel 414 via an endless belt 413 which may be a flexible toothed belt. The diameter of belt wheel 412 is substantially smaller than the diameter of belt wheel 414, allowing a reduction in the speed of drive shaft 411. Belt wheel 414 is rotatably connected to a drive bush 415. A gear with gear wheels can also be used instead of a transmission unit 402 with belt drive. Other alternatives are also possible.

A rod 417*a* is transversely displaceable within the drive bush 415 which is appropriately mounted. The translation movement of rod 417*a* is achieved via a spindle drive 403 having a spindle nut 416 which cooperates with rod 417*a*. At the end region of rod 417*a*, remote from transmission unit 402, there is formed a guide member 418 into which rod 417*a* can be introduced. A rod 417*b* adjoins rod 417*a*. An insert 423 is provided in the transition region between rod 417*a* and rod 417*b*. Insert 423 has pins 420 which project substantially perpendicularly to the axial direction of rod 417*a* or 417*b* and engage in slots 419 in guide member 418. This ensures that rod 417*a* and 417*b* does not rotate. Rod 417*b* is connected to a plunger 404. Plunger 404 is releasably arranged on rod 417*b* so that it can be formed according to the rivets used. A stop member 422 is provided at the front end region of rod 417*b*. Spring elements 421 are arranged between stop member 422 and insert 423. Spring elements 421 are spring washers arranged in a tubular portion of guide member 418. Guide member 418 is arranged so as to slide in a housing 425. The joining device is shown in a position in which plunger 404 and clamp 405 rest on the parts to be joined 407 and 408, which also rest on a die 406.

In a punch rivet connection formed by a grooved solid rivet, the rivet is pressed through the parts to be joined 407 and 408 by plunger 404 once the workpieces have been fixed between die 406 and hold down device/clamp 405. Clamp 405 and plunger 404 effect clinching. The rivet then punches a hole in the parts to be joined, after which, clamp 405 presses against these parts to be joined. The clamp presses against the die such that the die-side part to be joined 408 flows into the groove of the rivet owing to a corresponding design of die 406. The variation of the force as a function of the displacement can be determined by the process according to the invention from the power consumption of the electric motor drive 401. For example, during the cutting process, plunger 404 and, therefore also the rivet, covers a relatively great displacement wherein the force exerted by plunger 404 on the rivet is relatively constant. Once the rivet has cut through the plunger side part to be joined 407, the rivet is spread into die 406 as the force of plunger 404 increases. The die side part to be joined 408 is deformed by die 406 during this procedure. If the force exerted on the rivet by plunger 404 is sustained, the rivet is compressed. If the head of the punch rivet lies in a plane of the plunger-side part to be joined 407, the punch rivet connection is produced. The force/displacement curve can be determined from the process data. With a known force/displacement curve which serves as a reference, the quality of a punch connection can be determined by means of the measured level of the force as a function of the displacement.

The drive unit, monitoring unit and the spindle drive can have corresponding sensors for picking up specific characteristics, the output signals of which are processed in the monitoring unit. The monitoring unit can be part of the control unit. The monitoring unit emits input signals as open and closed loop control variables to the control unit. The sensors can be displacement and force transducers which determine the displacement of the plunger as well as the force of the plunger on the parts to be joined. A sensor which measures the power consumption of the electric motor action drive unit can also be provided, as power consumption is substantially proportional to the force of the plunger and optionally of the clamp on the parts to be joined.

In this alternate embodiment, the speed of the drive unit can also be variable. Owing to this feature, the speed with which the plunger or the clamp acts on the parts to be joined or the rivet can be varied. The speed of the drive unit can be adjusted as a function of the properties of the rivet and/or the properties of the parts to be joined. The advantage of the adjustable speed of the drive unit also resides in the fact that, for example, the plunger and optionally the clamp is initially moved at high speed to rest on the parts to be joined and the plunger and optionally the clamp is then moved at a lower speed. This has the advantage of allowing relatively fast positioning of the plunger and the clamp. This also affects the cycle times of the joining device.

It is further proposed that the plunger and optionally the clamp be movable from a predeterminable rest position that can be easily changed through the computer software. The rest position of the plunger and optionally of the clamp is selected as a function of the design of the parts to be joined. If the parts to be joined are smooth metal plates, the distance between a riveting unit which comprises the plunger and the clamp and a die can be slightly greater than the thickness of the superimposed parts to be joined. If a part to be joined has a ridge, as viewed in the feed direction of the part to be joined, the rest position of the riveting unit is selected such that the ridge can be guided between the riveting unit and the die. Therefore, it is not necessary for the riveting unit always to be moved into its maximum possible end or home position.

A force or a characteristic corresponding to the force of the plunger, and optionally of the clamp, can be measured in this alternate embodiment during a joining procedure as a function of the displacement of the plunger or of the plunger and the clamp. This produces a measured level. This is compared with a desired level. If comparison shows that the measured level deviates from the desired level by a predetermined limit value in at least one predetermined range, a signal is triggered. This process control advantageously permits qualitative monitoring of the formation of a punch connection.

This embodiment of the process also compares the measured level with the desired level at least in a region in which clinching is substantially completed by the force of the plunger on a rivet. A statement as to whether a rivet has been supplied and the rivet has also been correctly supplied can be obtained by comparing the actual force/displacement trend with the desired level. The term 'correctly supplied' means a supply where the rivet rests in the correct position on the part to be joined. It can also be determined from the result of the comparison whether an automatic supply of rivets is being provided correctly.

The measured level is also compared with the desired level at least in a region in which the parts to be joined have been substantially punched by the force of the plunger on a rivet, in particular a solid rivet, and the clamp exerts a force on the plunger-side part to be joined. This has the advantage that it is possible to check whether the rivet actually penetrated the parts to be joined.

According to this embodiment of the process, the measured level is compared with the desired level, at least in a region in which a rivet, in particular a hollow rivet, substantially penetrated the plunger-side part to be joined owing to the force of the plunger and a closing head was formed on the rivet. It is thus also possible to check whether the parts to be joined also have a predetermined thickness. A comparison between the measured level and the desired level is performed, at least in a region in which a closing head is substantially formed on the rivet, in particular a hollow rivet, and clinching of the rivet takes place. It is thus possible to check whether the rivet ends flush with the surface of the plunger-side part to be joined.

Figures 12A, 12B, 12C, 12D, 12E, 12F:
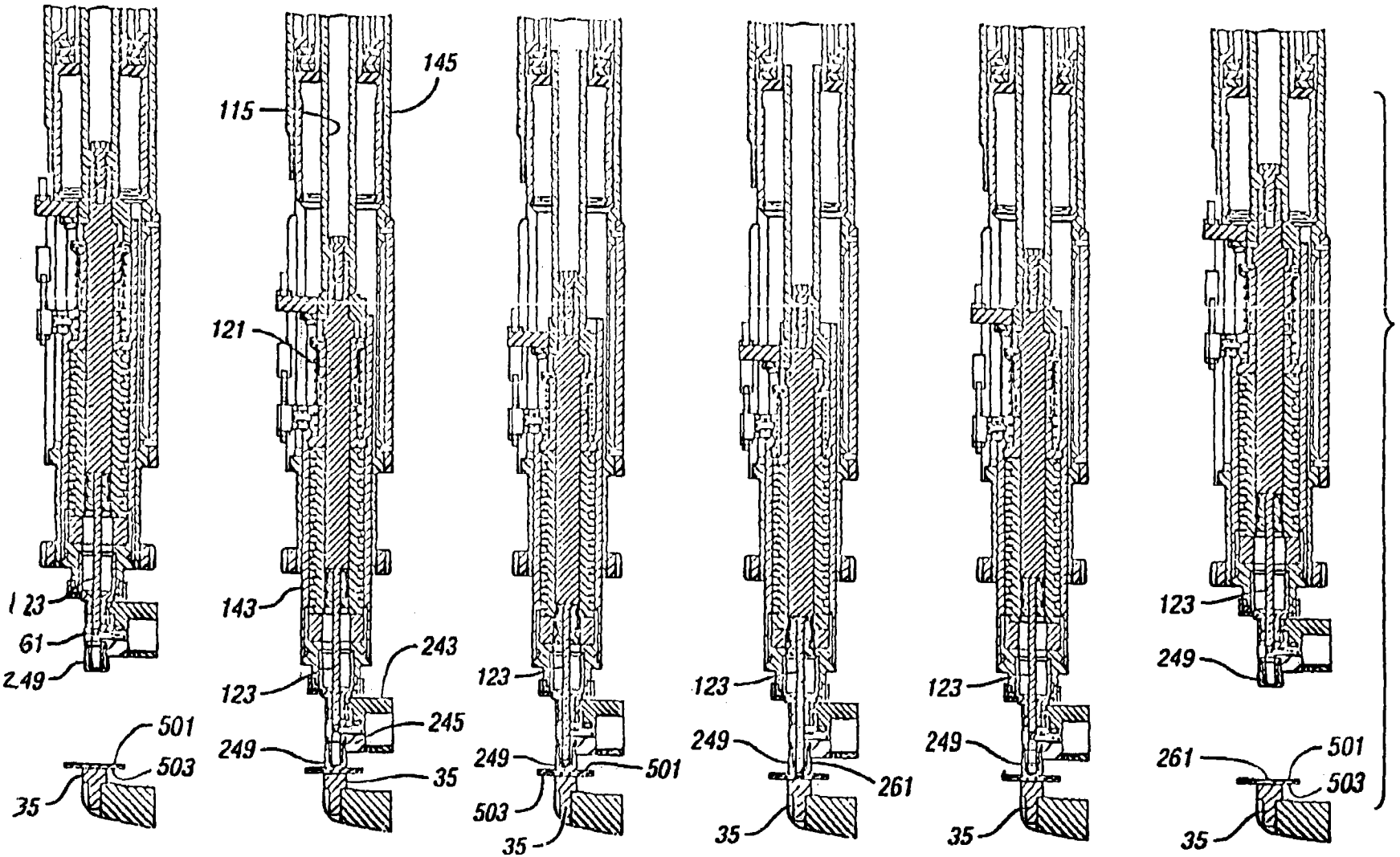
FIGS. 12*a*-12*f* are a series of cross sectional views, similar to that of FIG. 6, showing the self-piercing riveting sequence of the preferred embodiment riveting system.

Returning to the preferred embodiment, FIGS. 12*a*-12*f* and FIGS. 13*a*-13*e* show the riveting process steps employing the system of the present invention. The preferred rivet employed is of a self-piercing and hollow type which does not fully pierce through the die-side workpiece. First, FIGS. 12*a* and 13*a* show the clamp/nose piece 249 and punch 123 in retracted positions relative to workpieces 501 and 503. Workpieces 501 and 503 are preferably stamped sheet metal body panels of an automotive vehicle, such as will be found on a conventional pinch weld flange adjacent the door and window openings. The robot and linear slides will position the riveting tool adjacent the sheet metal flanges such that nose piece 249 and die 35 sandwich workpieces 501 and 503 therebetween at a target joint location. It is alternately envisioned that a manually (non-robotic) moved riveting tool or a stationary riveting tool can also be used with the present invention.

FIG. 12*b* shows clamp/nose piece 249 clamping and compressing workpieces 501 and 503 against die 35. Punch 123 has not yet begun to advance rivet 261 toward workpieces 501 and 503. At this point, the plate thickness proximity switch senses the thickness of the workpieces through actual location of the clamp assembly; the plate thickness switch sends the appropriate signal to the main controller. Next, punch 123 advances rivet 261 to a point approximately 1 millimeter above the punch-side workpiece 501. This is shown in FIGS. 12*c* and 13*b*. If the workpiece thickness dimension is determined to be within an acceptable range by the main electronic control unit then energization of the electric motor further advances punch 123 to insert rivet 261 into punch-side workpiece 501, as shown in FIG. 13*c*, and then continuously advances the rivet into die-side workpiece 503, as shown in FIGS. 12*d* and 13*d*. Die 35 serves to outwardly deform and diverge the distal end of rivet 261 opposite punch 123.

FIG. 12*e* shows the punch subsequently retracted to an intermediate position less than the full home position while clamp/nose piece 249 continues to engage punch side workpiece 501. Finally, punch 123 and clamp/nose piece 249 are fully retracted back to their home positions away from workpieces 501 and 503. This allows workpieces 501 and 503 to be separated and removed from die 35 if an acceptable riveted joint is determined by the main electronic control unit based on sensed joint characteristics. As shown in FIG. 13*e*, an acceptable riveted joint has an external head surface of rivet 261 positioned flush and co-planar with an exterior surface of punch-side workpiece 501. Also, in an acceptable joint, the diverging distal end of rivet 261 has been sufficiently expanded to engage workpiece 503 without piercing completely through the exterior surface of die-side workpiece 503.

Figure 14:
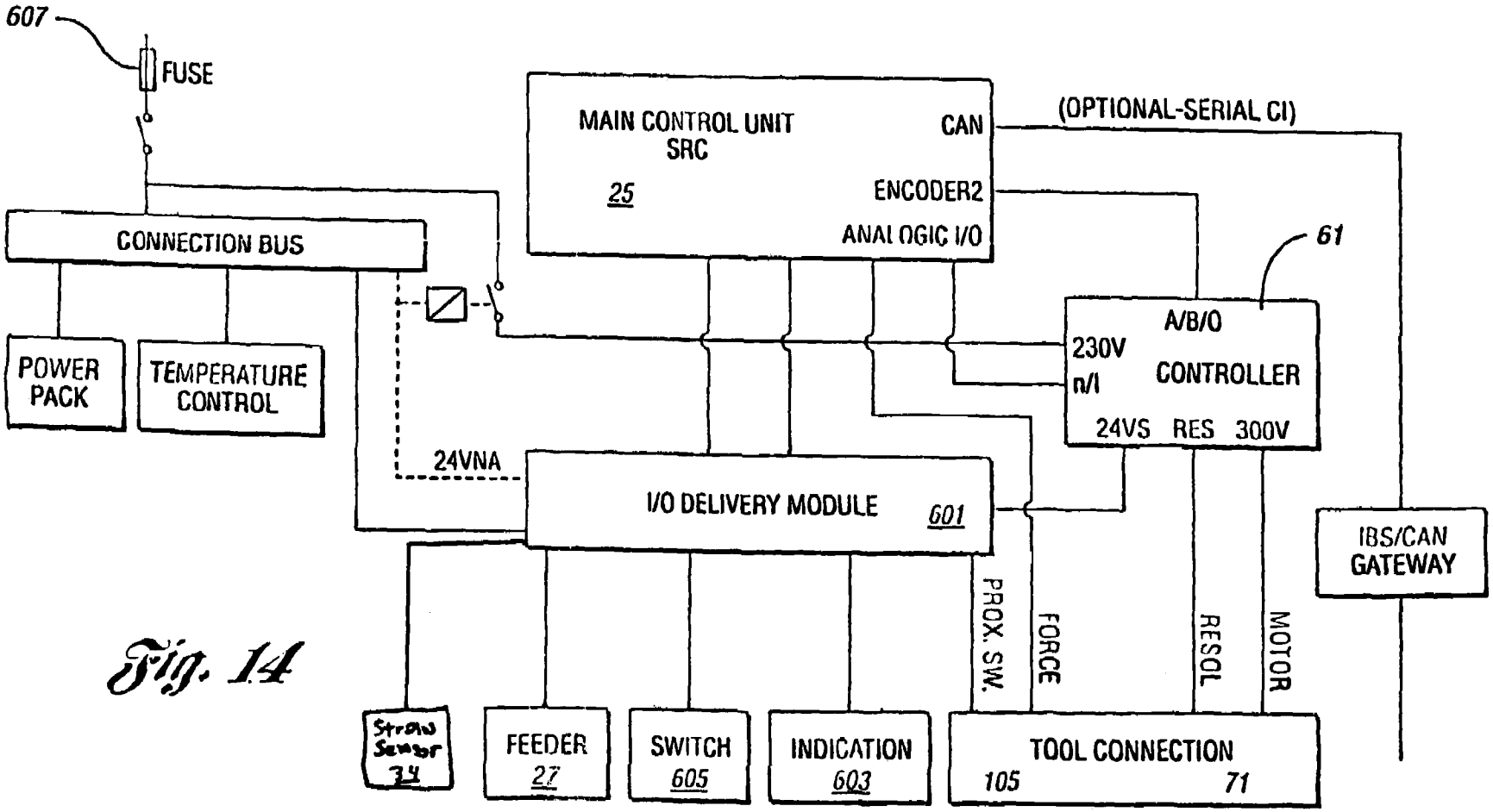
FIGS. 14 and 15 are diagrammatic views showing the control system of the preferred embodiment riveting system.

A simplified electrical diagram of the preferred embodiment riveting system is shown in FIG. 14. Main electronic control unit 25, such as a high speed industrial microprocessor computer, having a cycle time of about 0.02 milliseconds purchased from Seimons Co., has been found to be satisfactory. A separate microprocessor controller 61 is connected to main electronic control unit 25 by way of an analog input/output line and an Encoder2 input which measures the position of the spindle through a digital signal. Controller 61 receives an electric motor signal and a resolver signal. The load cell force signal is sent directly from the tool connection 105 to the main electronic control unit 25 while the proximity switch signals (from the feeder, feed tube and spindle home position sensors) are sent from the tool connection 71 through an input/output delivery microprocessor module 601 and then to main electronic control unit 25. Input/output delivery microprocessor module 601 actuates error message indication lamps 603, receives a riveting start signal from an operator activatable switch 605 and relays control signals to feeder 27 from main electronic control unit 25. An IBS/CAN gateway transmits data from main electronic control unit 25 to a host system which displays and records trends in data such as joint quality, workpiece thickness and the like. Controller 61 is also connected to a main power supply via fuse 607.

Figure 16:
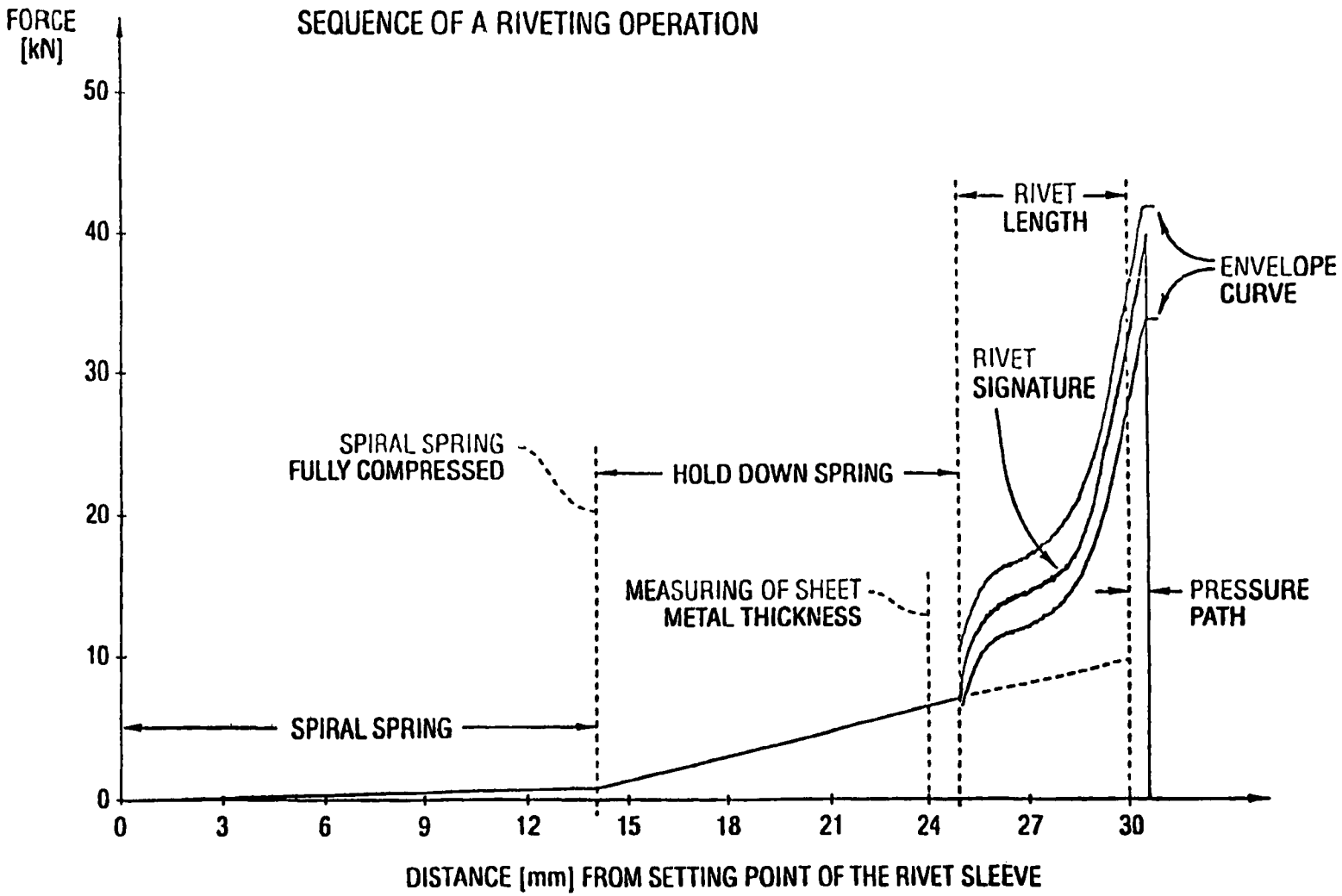
Figure 12:
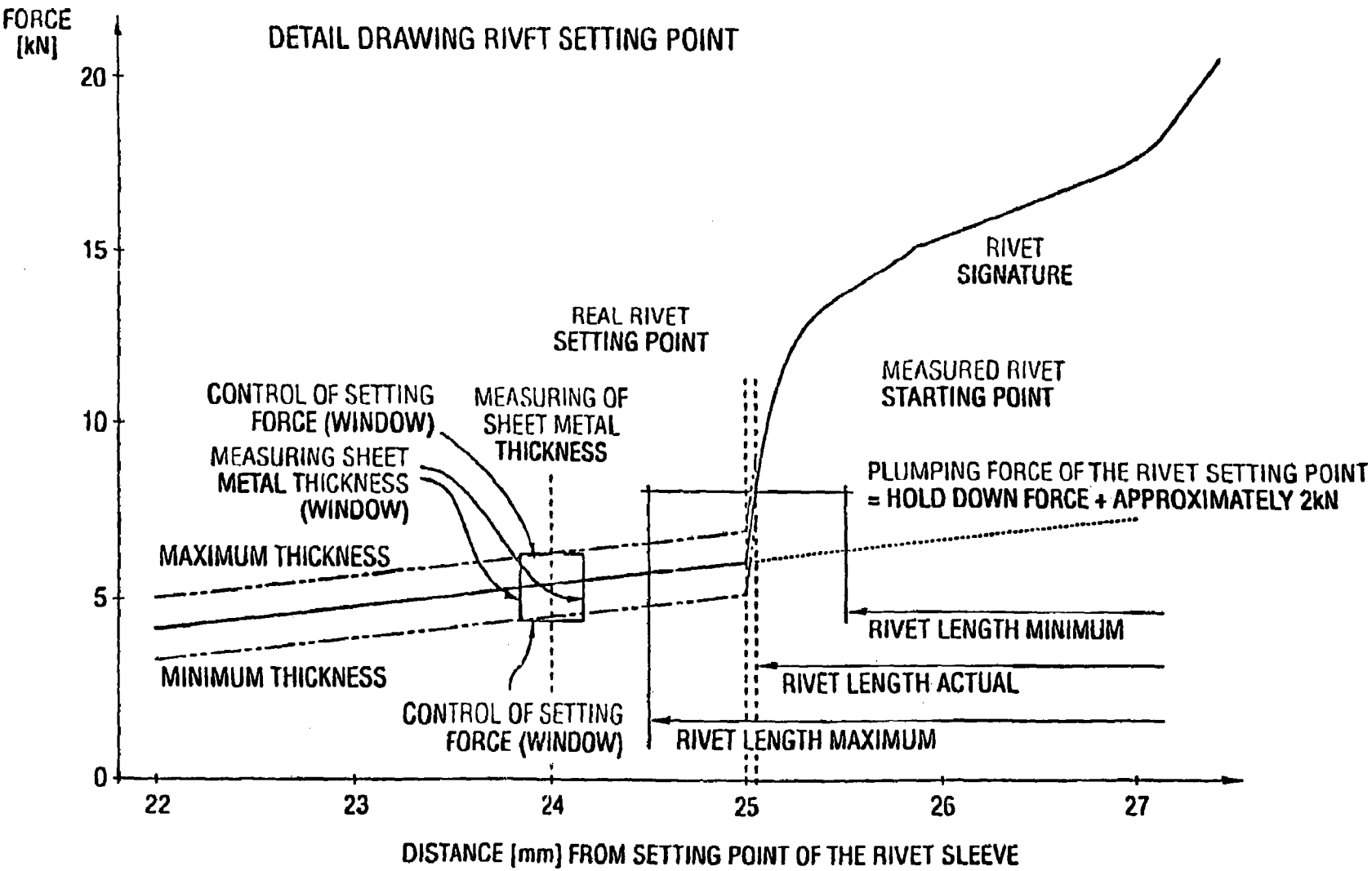
Figure 18A:
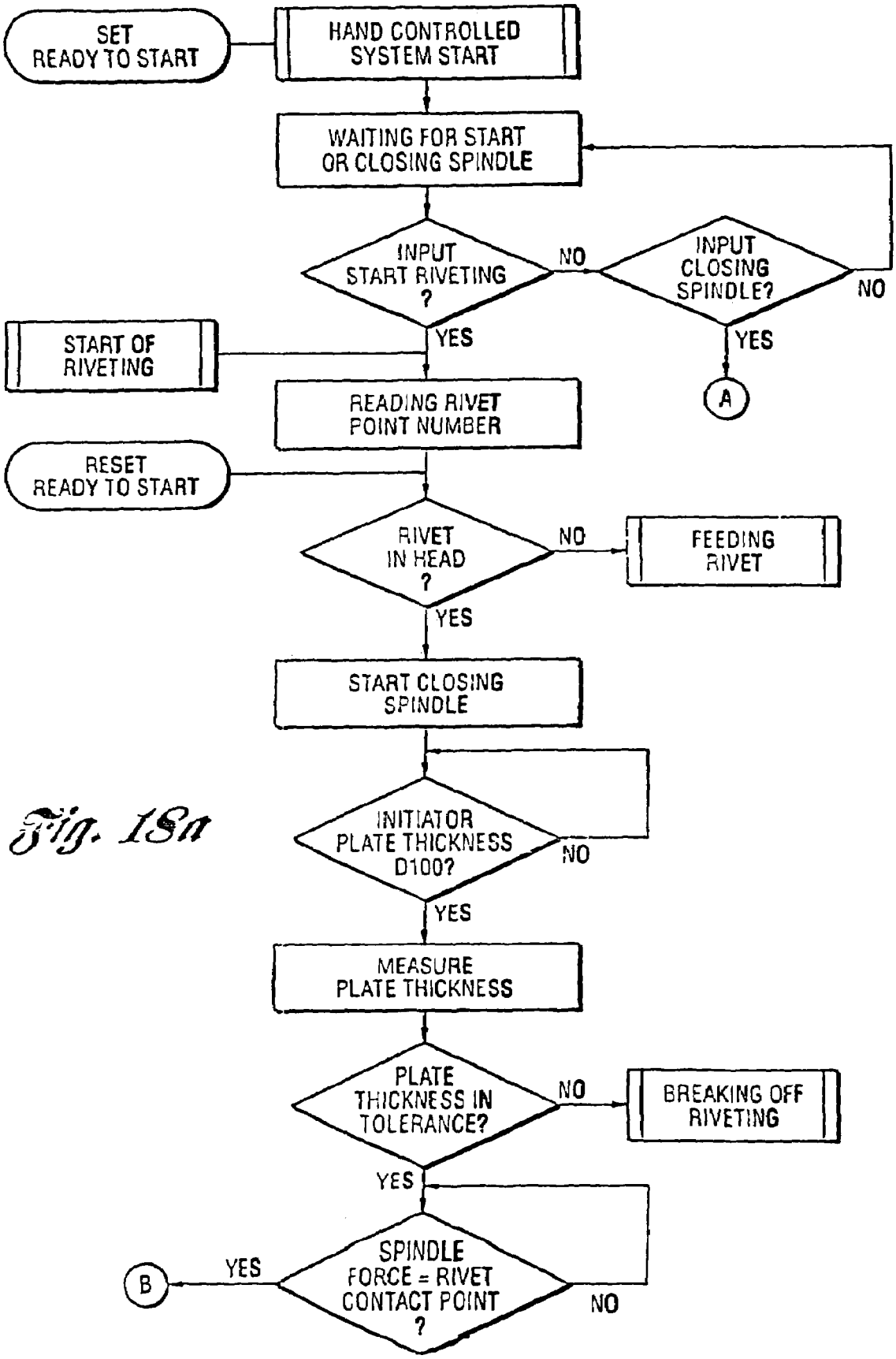
Figure 18B:
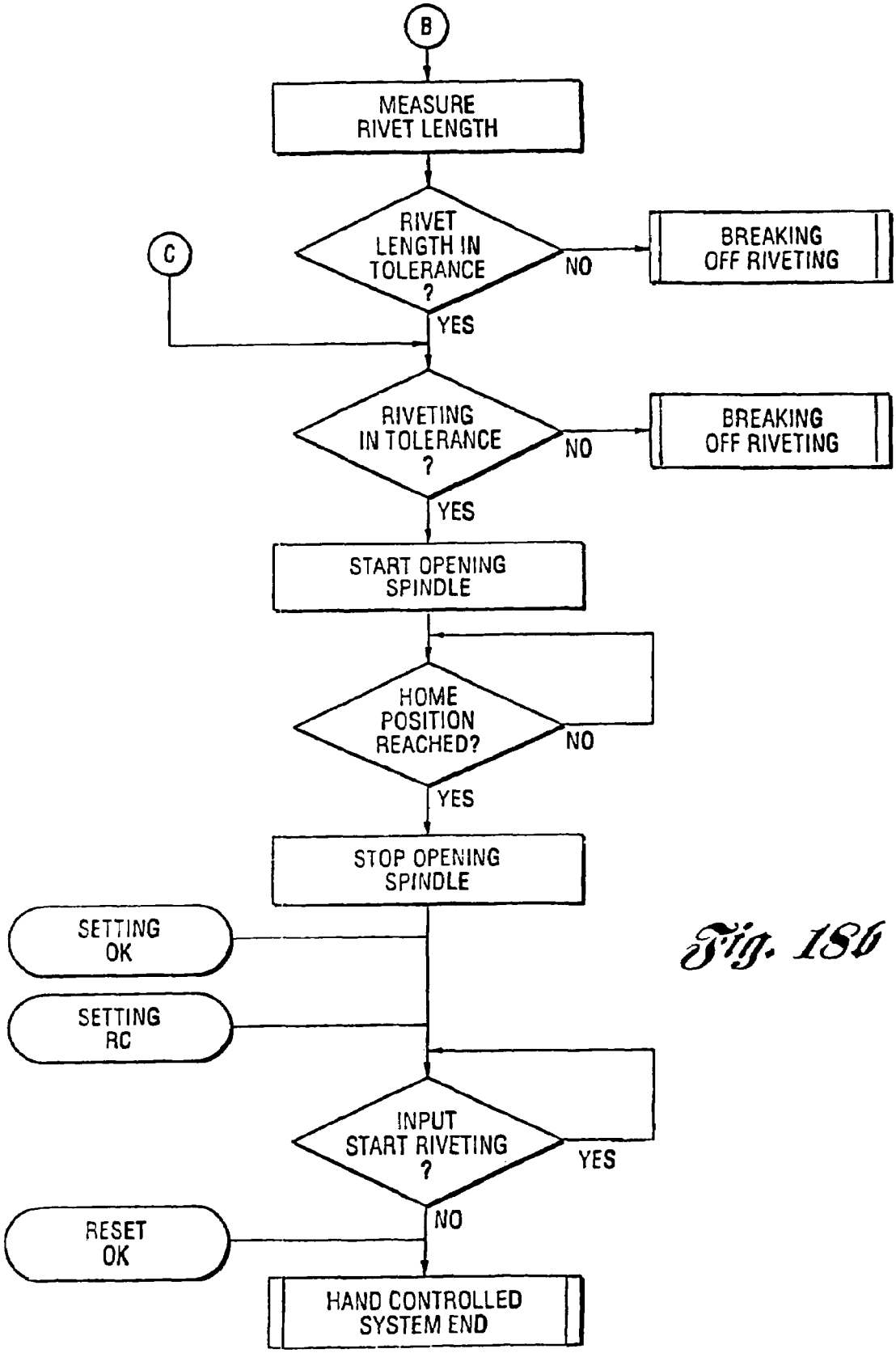
Figure 18C:
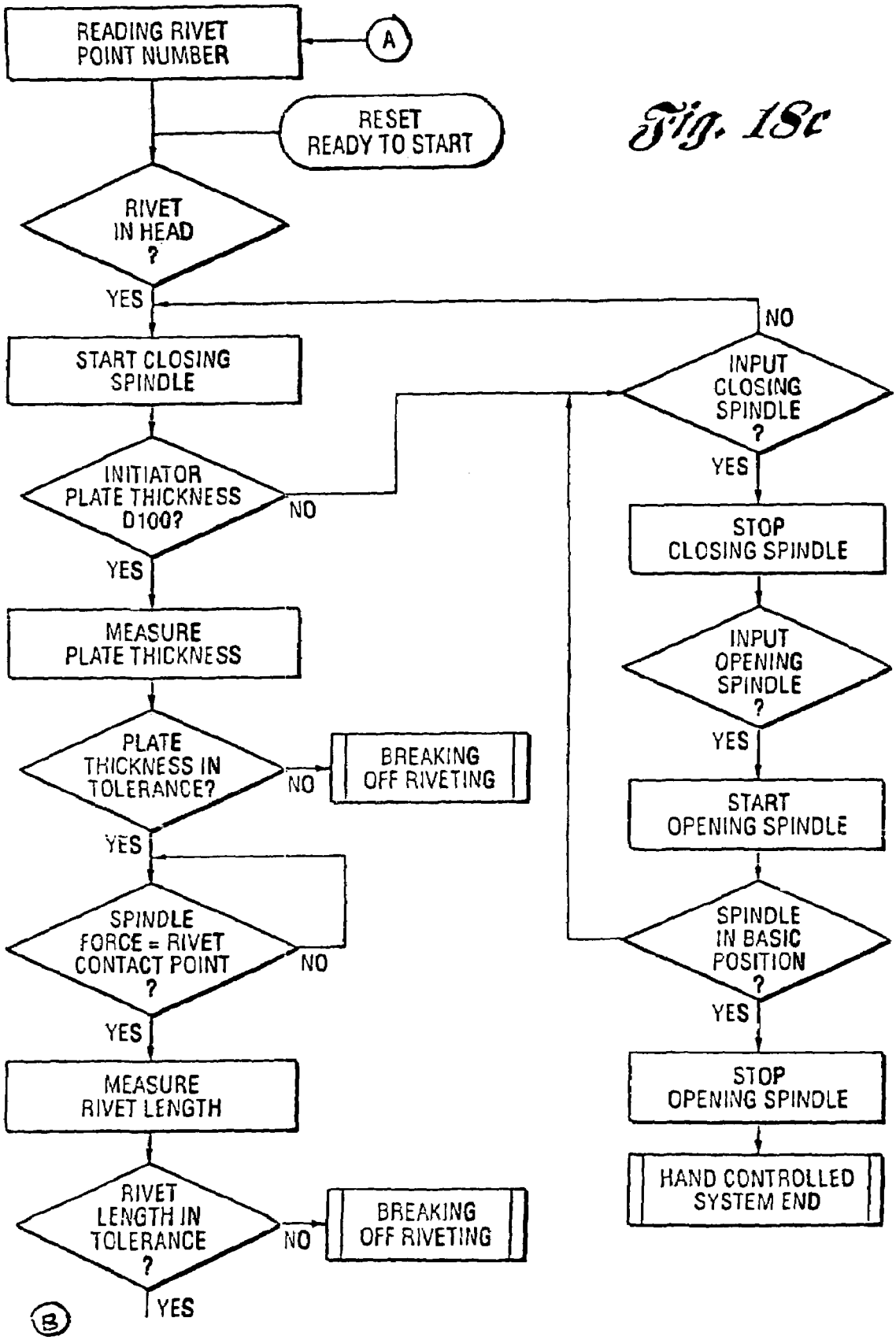
Figure 18B:
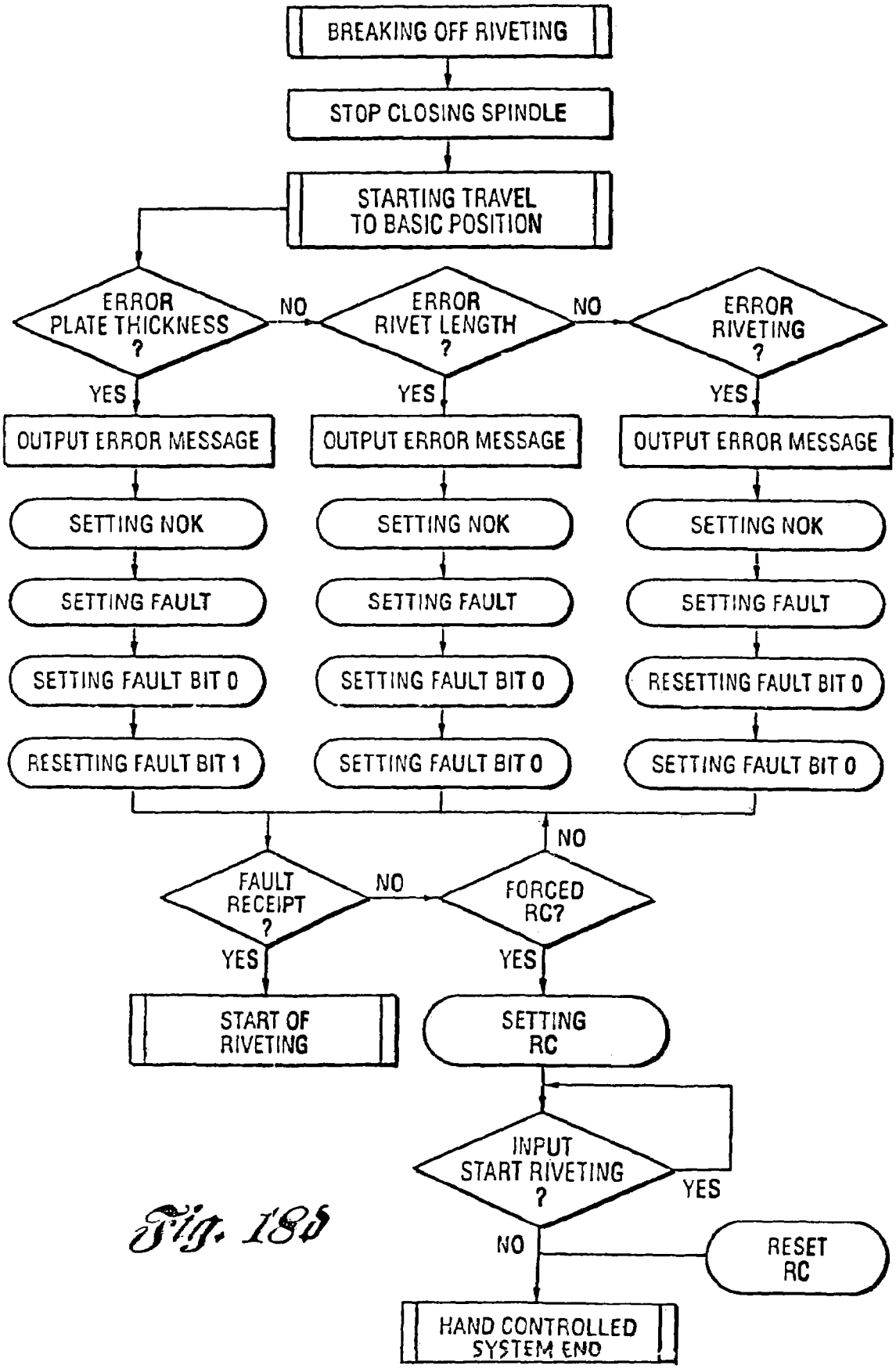

FIG. 16 is a strain/distance (displacement) graph showing a sequence of a single riveting operation or cycle. The first spiral spring distance range is indicative of the force and displacement of punch 123 due to light spring 128. The next displacement range entitled hold down spring, is indicative of the force and displacement generated by heavy spring 141, clamp 143 and the associated clamping nose piece 249. Measurement of the sheet metal/workpiece thickness occurs at a predetermined point within this range, such as 24 millimeters from the home position, by way of load cell 103 interacting with main electronic control unit 25. In the next rivet length range, the rivet length is sensed and determined through load cell 103 and main electronic control unit 25. The middle line shown is the actual rivet signature sensed while the upper line shown is the maximum tolerance band and the lower line shown is the minimum tolerance band of an acceptable rivet length for use in the joining operation. If an out of tolerance rivet is received and indicated then the software will discontinue or "break off" the riveting process and send the appropriate error message.

FIG. 17 shows a stain versus distance/displacement graph for the rivet setting point. The sensed workpiece thickness, the middle line, is compared to a prestored maximum and minimum thickness acceptability lines within the main electronic control unit 25. This occurs at a predetermined distance of movement by the clamp assembly from the home position or other initialized position. The rivet length (or other size or material type) signature is also indicated and measured. Load cell 103 senses force of the clamp assembly and punch assembly. The workpiece thickness is determined by comparison of a first sensed force value at a preset displacement versus a preprogrammed force value at that location. Subsequently sensed force values are also compared to preset acceptable values; these subsequent sensed force values are indicative of rivet size and joint quality characteristics. The computer is always on-line with the tool and process in a closed-loop manner. This achieves a millisecond, real time control of the process through sensed values.

FIGS. 18*a*-18*d* show a flow chart of the computer software used in the main electronic control unit 25 for the preferred embodiment riveting system of the present invention. The beginning of the riveting cycle is started through an operator actuated switch, whereafter the system waits for the spindle to return to a home position. From a prestored memory location, a rivet joint number is read in order to determine the prestored characteristics for that specific joint in the automotive vehicle or other workpiece (e.g., joint number 16 out of 25 total). Thus, the workpiece thickness, rivet length, rivet quality and force versus distance curves are recalled for comparison purposes for the joint to be riveted.

Next, the software determines if a rivet is present in the head based upon a proximity switch signal. If not, the feeder is energized to cause a rivet to be fed into the head. The spindle is then moved and the workpiece is clamped. The plate or workpiece thickness is then determined based on the load cell signals and compared against the recalled memory information setting forth the acceptable range. If the plate thickness is determined to be out of tolerance, then the riveting process is broken off or stopped. If the plate thickness is acceptable for that specific joint, then the rivet length is determined based on input signals from the load cell. If the punch force is too large, too soon in the stroke, then the rivet length is larger than an acceptable size, and vice versa for a small rivet. The riveting process is discontinued if the rivet length is out of tolerance.

The spindle is then retracted after the joint is completed. As described below, the system will monitor the output of the strain cage 34 to determine if a rivet set is acceptable. After the spindle is opened or retracted to the programmed home position, which may be different than the true and final home position, indicator signals are activated to indicate if the riveted joint setting is acceptable (OK), if the riveting cycle is complete (RC), and is ready for the next rivet setting cycle (reset OK). It should also be appreciated that various resolver signals and motor power consumption signals can also be used by second microprocessor 61 to indicate other quality characteristics of the joint although they are not shown in these flow diagrams. However such sensor readings would be compared against prestored memory values to determine whether to continue the riveting process, or discontinue the riveting process and send an error signal. Motor sensor readings can also be used to store and display cycle-to-cycle trends in data to an output device such as a CRT screen or printout.

FIG. 18*d* shows a separate software subroutine of error messages if the riveting process is broken off or discontinued. For example, if the plate thickness is unacceptable, then an error message will be sent stating that the setting is not okay (NOK) with a specific error code. Similarly, if the rivet length was not acceptable then a not okay setting signal will be sent with a specific error code. If another type of riveting fault has been determined then another rivet setting not okay signal will be sent and a unique error code will be displayed.

Figure 19:
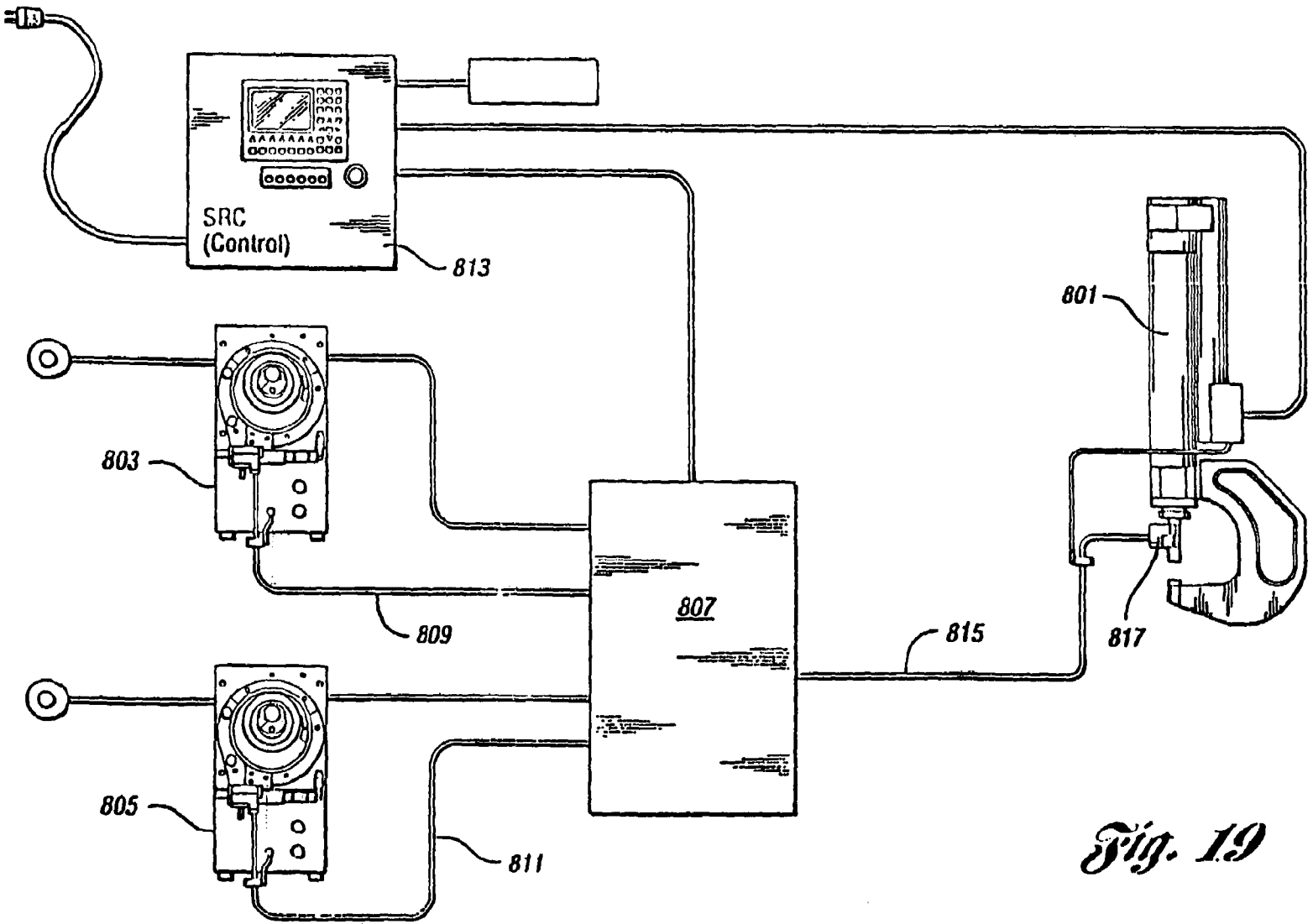
FIG. 19 is a partially diagrammatic, partially side elevational view showing a second alternate embodiment riveting system.

Another alternate embodiment riveting system is illustrated in FIG. 19. A robotically controlled riveting tool 801 is essentially the same as that disclosed with the preferred embodiment. However, two separate rivet feeders 803 and 805 are employed. Rivet feeders 803 and 805 are of the same general construction as that disclosed with the preferred embodiment, however, the rivet length employed in the second feeder 805 is longer (such as 5 millimeters in total length) than that in the first feeder 803 (such as a total rivet length of 3 millimeters). Each feeder 803 and 805 transmits the specific length rivets to a selector junction device 807 by way of separate input feed tubes 809 and 811. Selector device 807 has a pneumatically actuated reciprocating slide mechanism which is electrically controlled by a main electronic control unit 813. When main electronic control unit 813 recalls the specific joint to be worked on, it then sends a signal to selector device. 807 as to which rivet length is needed. Selector device 807 subsequently mechanically feeds the correct rivet through a single exit feed tube 815 which is connected to a receiver 817 of riveting tool 801.

Thus, a single riveting tool can be used to rivet multiple joints having rivets of differing selected sizes or material characteristics without the need for complicated mechanical variations or multiple riveting tool set ups. The software program within main electronic control unit 813 can easily cause differing rivets to be sent to the single riveting tool 801, while changes can be easily made simply by reprogramming of the main electronic control unit. This saves space on the crowded assembly plant line, reduces mechanical complexity and reduces potential failure modes.

The accuracy of riveting, as well as measurements in the preferred embodiment, are insured by use of the highly accurate electric servo motor and rotary-to-linear drive mechanism employed. For example, the rivet can be inserted into the workpieces with one tenth of a millimeter of accuracy. The control system of the present invention also provides a real time quality indication of the joint characteristics, rather than the traditional random sampling conducted after many hundreds of parts were improperly processed. Thus, the present invention achieves higher quality, greater consistency and lower cost riveted joints as compared to conventional constructions.

Figure 20:
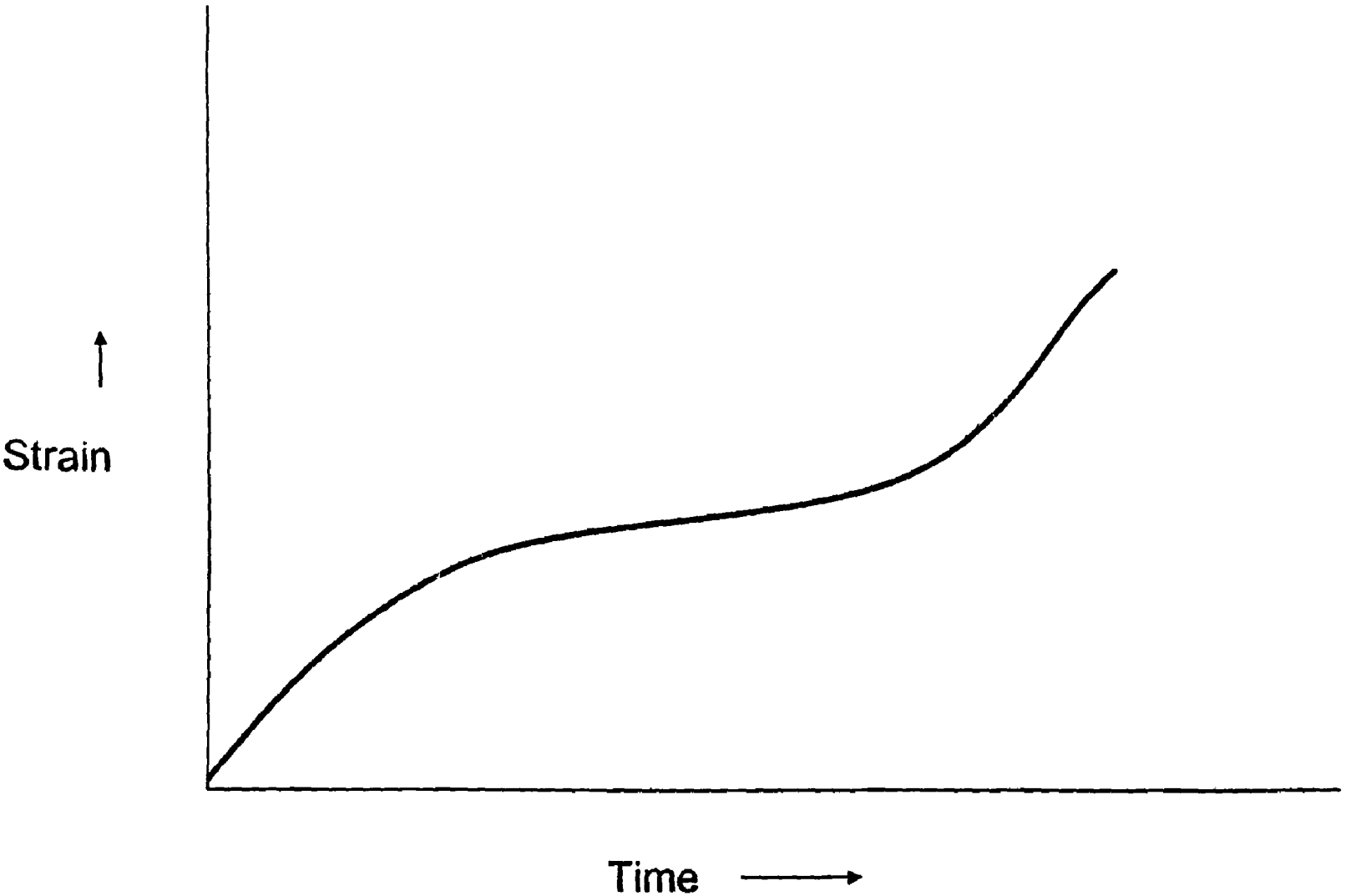
FIG. 20 represents a strain versus time curve for a self piercing rivet set.

FIG. 20 represents a strain verse time curve of an acceptable riveted joint has an external head surface of rivet 261 positioned flush and co-planar with an exterior surface of punch-side workpiece. Also, in an acceptable joint, the diverging distal end of rivet 261 has been sufficiently expanded to engage workpiece without piercing completely through the exterior surface of die-side workpiece 501, 503.

It should be noted that depending on the type of fastener or fastener setting equipment used, different shaped curves are equally possible. Furthermore, the sensor 33 used in the system 21 of the present invention does not rely on the strains formed within the c-shaped frame 37 of the rivet tool 23 as a perfect or alternative mechanism for determining the amount of force or load being applied to the rivet 261. As described below, while the time duration and magnitude of portions of these curves can vary by specific amounts, large deviations of these curves represent either a failure of the rivet set or a failure of the structure. As the system utilizes an average of "good" sets histories to set an acceptable median load profile, the profile generated by the system is relatively independent of the orientation of the sensor 33 on the c-shaped frame 37 or the specific manufacturing environment of the c-shaped frame 37. This is opposed to other systems which use load cell versus stroke length to perform an interpretation of an independent load stroke curve.

The graphs of the strain against distance or time show overlapping and changing shape of the lines. It is difficult to identify a consistent point or consistent points on these curves due to the apparently unstable nature of the curves. It is noted that the above setting curves are typical for open-end self-piercing rivets where the rivet teeth enter the sheet metal giving a characteristic peak to the curve as shown in FIG. 20. This peak is designated as Ps, Ts for the rivet setting load and time.

For these cases of open-end self-piercing rivet curves, one method of comparison is the monitoring continuously the output from the load-measuring device and comparing continuously this data against a known rivet setting profile. In order to accommodate rivet manufacturing variations a tolerance is applied to the setting curves that is usually shown as a set of banding tolerance curves G3. Thus, for any new self-piercing rivet being set, the resulting curves from this new setting should fall between the banding tolerance curves.

While functional, the setting of banding curves to accommodate the variations of setting curves that result from rivets with normal manufacturing tolerances of self-piercing rivets and the application pieces is difficult and may have to be set too wide. This wide tolerance banding will, thus accept settings which will otherwise be rejected if small differences of, for example, work piece grip thickness need to be identified.

Figure 21:
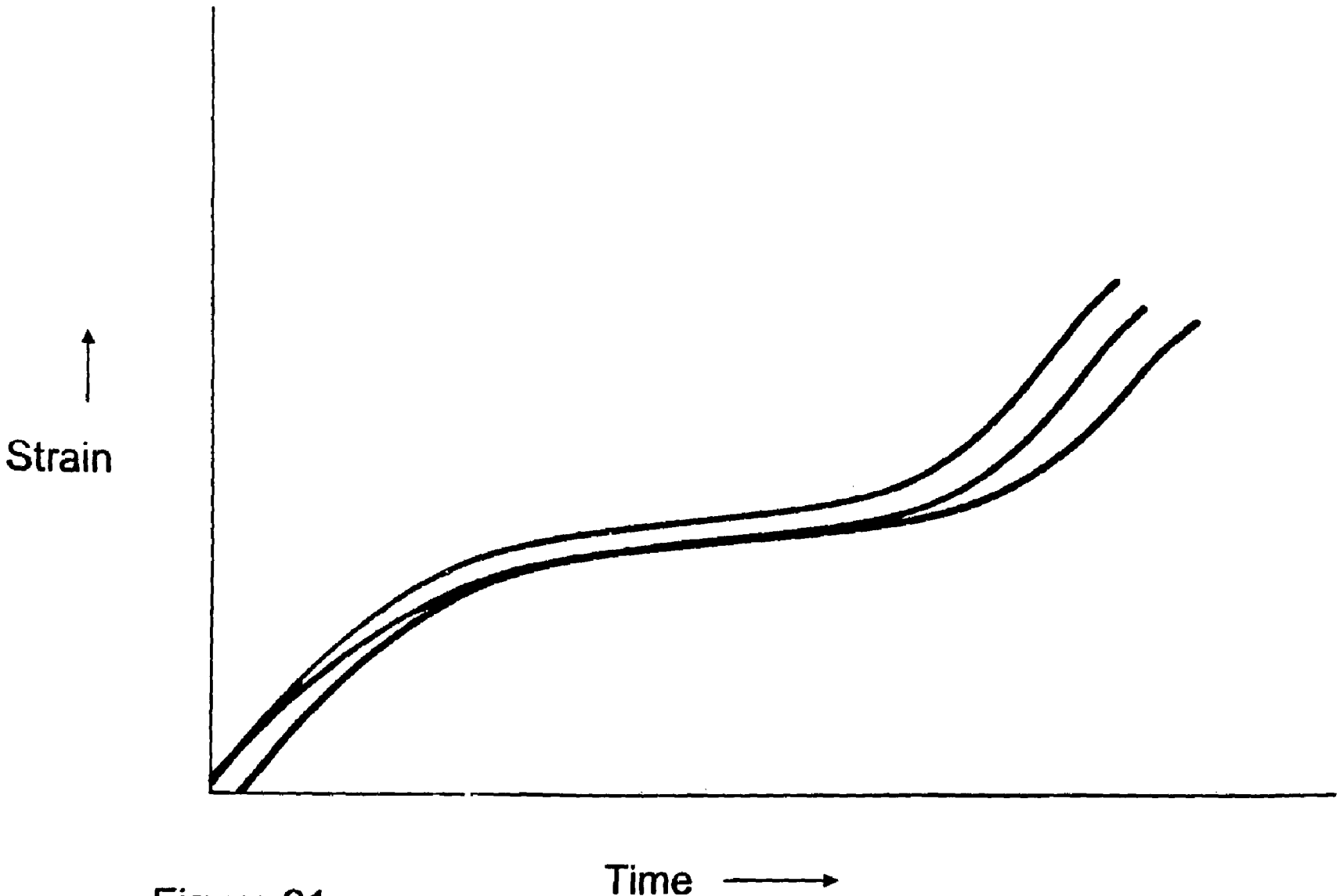
FIG. 21 represents a series of training strain versus time curves used to set the tolerance bands.

FIG. 21 represents a methodology to determine the tolerance bands. The statistically significant strain and time or distance co-ordinates from these subsequent self-piercing rivet settings are monitored, and collated. An exemplary set of data is formed form these strain verse time data. Tolerance bands are constructed based on the statistically significant sets of training data. There are various conditions that may exist in the setting of self-piercing rivets and these will be described separately with respect to FIG. 4*c* as follows:

First condition is for the setting of a rivet that has nominal tolerances in terms of rivet body length and rivet teeth deformation load and has been set normally by a well prepared setting tool. This would be deemed to be a good setting in that the rivet curve stays within any developed tolerance zones.

Second condition is for the setting of a rivet that has maximum tolerances in terms of rivet body length and rivet teeth deformation load and has been set normally by a well prepared setting tool. This also would be deemed to be a good setting in that the rivet curve stays within any developed tolerance limits.

Third condition is for the setting of a rivet where the rivet teeth have been manufactured to a size that is below specification but with otherwise nominal tolerances in terms of rivet body length and rivet teeth deformation load and has been set normally by a well prepared setting tool. This would be deemed to be a bad setting in that the rivet curve migrates from the desirable tolerance zones.

Thus, it can be seen that the rivet must adhere to three separate criteria to be seen to have given a good setting. Firstly, the initial part of the curve must pass along the tolerance zone as this represents the initial work by the rivet. This is the clamping of the work piece plates together, the commencement and completion of hole filling. Further, this portion contains data when either rivet teeth entry into the sheet metal in the case of the open-end rivet or the commencement of the roll type setting in the case of the retained mandrel head type. These criteria are used to develop sets of rules regarding time or force tolerance bands.

To generate a baseline to compare the quality of rivets, a baseline rivet set curve is generated. FIG. 21 represents a plurality of curves which are used to generate average strain or pressure versus time curves to be used by the system. Optionally, statistical techniques can be employed to determine if a sample load versus time curve is close enough to the meeting curve to determine if the specific curve is usable in formulating the meeting curve. Once the baseline curve is developed, the system 32 tracks the strain or pressure versus time data of each rivet set to determine if the system has created a potentially defective set.

Figure 22:
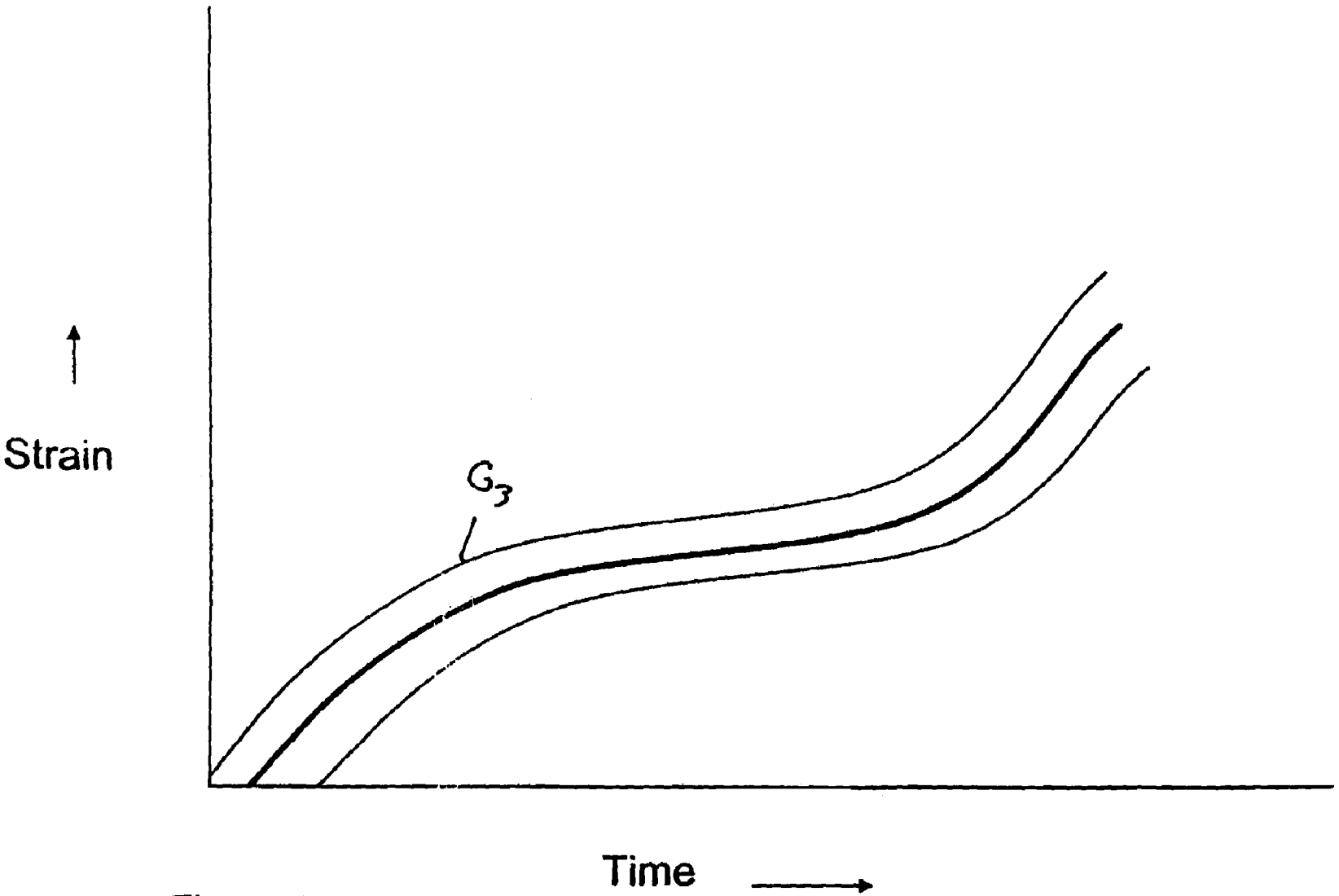
FIG. 22 represents an example a strain versus time curve for a self piercing rivet set and tolerance bands according to the teaching of the present invention.

FIG. 22 represents a tolerance curve or band G disposed upon a median or example curve. When evaluating a new rivet set, the system first initially aligns the subject data set to the data of the medial or reference curve. This occurs either by aligning the zero of the data sets as described, by aligning another feature such as the last local maximum, or aligning the first occurrence of a predefined strain value, then setting the zero at a few milliseconds prior to this time. Once the data is aligned, it is determined if the data associated with the breaking of the mandrel falls within the acceptable tolerance box. If the data falls outside of the tolerance box, an alarm is initiated.

In this system, all portions of the medium curve have the specific fixed size tolerance band defined around them. The system then tracks the strain or pressure versus time data or curve of an individual rivet set to determine whether it falls outside of the tolerance band. In case the rivet does fall outside of the specific tolerance band, an alarm or warning is presented to the line operator.

Figure 23:
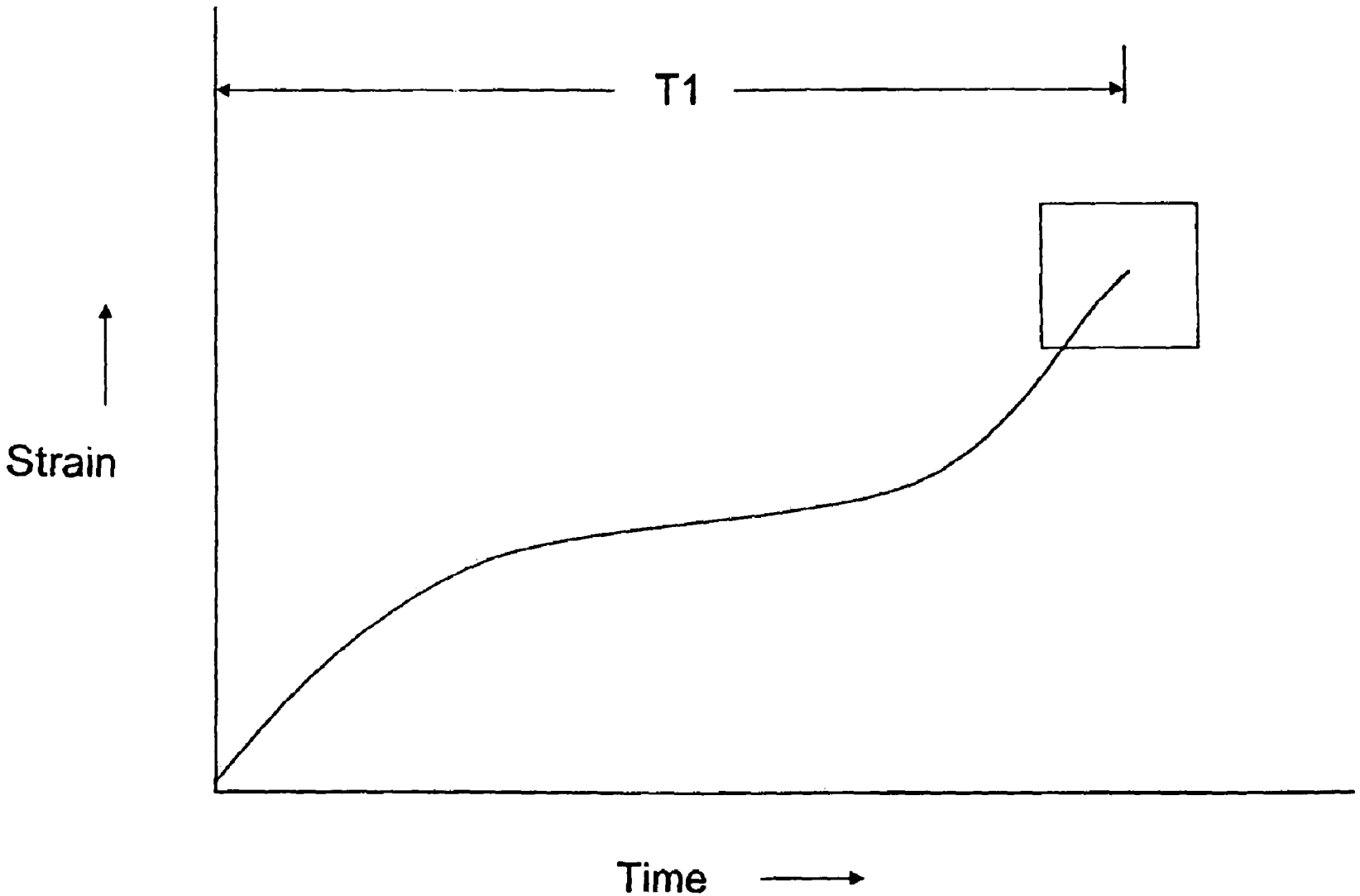
FIG. 23 represents an alternate method of assessing the quality of a rivet joint.

FIG. 23 represents an alternate tolerance channel or band for a rivet setting curve. Specifically, it should be noted that the varying tolerance heights depending on the portion of each curve. For example, during the component adjustment and deformation of the rivet body portion of the curve, the tolerance band is set for a first value while during the portion where the rivet mandrel is plastically deformed, the tolerance band is adjusted. Further the system identifies the length of time T1, needed to set the rivet. T1 is compared to an example Time Te to determine if an acceptable rivet set occurs.

The system can provide factory management data on build rate and production efficiency and link number of rivets used to an automatic rivet reordering schedule. Furthermore, it can be attached to fully automatic rivet setting machines and thus provide the assurance and insurance that the assembly has been completed in accordance to plan.

Figure 24:
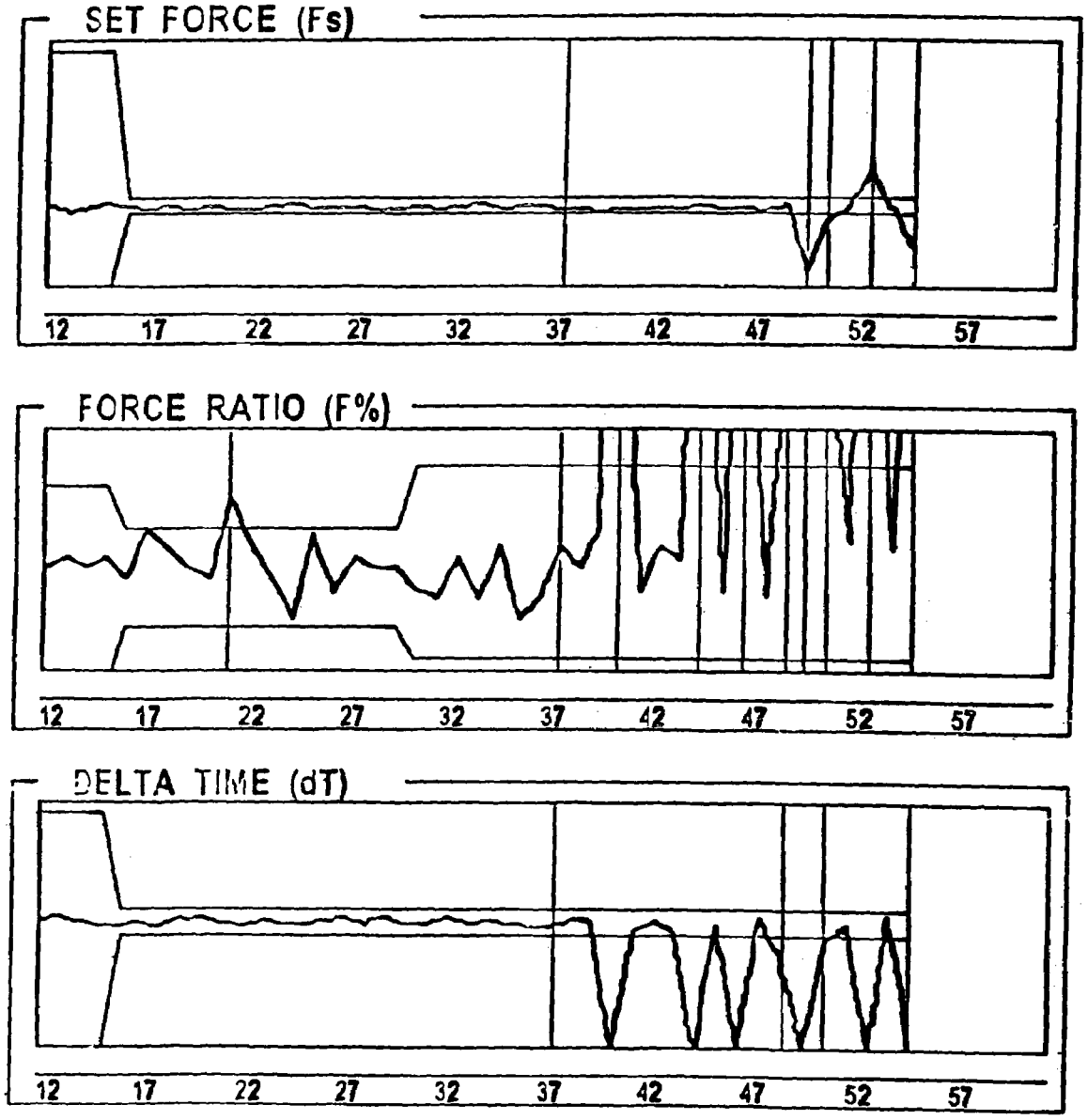
FIG. 24 represents quality checking of a series of fastener sets.

FIG. 24 represents a tracking quality of a series of fasteners. As can be seen, a pair of tolerance bands is provided and there is an indication when a particular fastener does not meet a particular measured or calculated quality value. When a predetermined number of fasteners in a row show a fault, the operator is alerted and instructed to determine whether there is likely a new lot of fasteners being used or whether a critical change has occurred to function of the equipment or the material being processed, which may require recalibration or changes of the system.

The above methods of comparison assume a random variation of manufacturing tolerances for the rivet and for the work piece. In practice, however, tolerances to the top or bottom of the range allowed can occur for one manufacturing batch and then move to the other extreme as new manufacturing tooling or a new production machine setting occur. Thus a group of setting curves from a single batch of fasteners may need to be made from a particular manufacturing batch. The resulting curves will show a set of values reflecting the size and strength of that batch. The batch may, however, have tolerances that will bias an average curve. For instance the batch may be related to maximum length and minimum break load and the average curve will reflect this trend. Thus in a production environment another batch of rivets could be a minimum length and maximum break load and thus fall outside of some of the tolerance bands of the reference rivets especially if they are set too close to the original curve. So in addition to the widening described above a further widening may also be necessary to accommodate the bias in the original learning curves. Tolerance bands that are set too wide thus increase the chance of accommodating either poor settings or undue rivet manufacturing variations.

Further according to the teachings of the present invention, a method for setting a fastener with a setting tool is presented. The method includes the step of first, defining a set of example strain/time or pressure/time data. A series of strain or pressure measurements are made for the rivet setting process which is being evaluated is sensed. The sensed strain or pressure versus time data is aligned by time with the series of example strain/time or pressure/time data. The occurrence of the highest value of strain or pressure is used to identify the mandrel breakpoint of the measured strain/time or pressure/time data. This measured breakpoint strain or pressure value is compared with a predetermined desired breakpoint strain or pressure value. The measured strain/time or pressure /time signals are compared to the example strain/time or pressure/time signals.

In both the case of the example strain or pressure data and the measured strain or pressure data, graphs or wave forms based on these series in the time domain can be produced. These waveforms can be scanned for predetermined characteristics, which are used to align the data. As previously mentioned, this can be the highest detected strain or pressure, a predetermined strain or pressure, or may be another feature such as a first local maximum above a given strain or pressure value.

When monitoring the setting of a blind rivet, the axial strain within a cast body of rivet setting tool is monitored during a rivet setting process to produce a series of micro-strained signals related thereto. Each of these micro-strain signals are assigned an appropriate time value to produce an array of strain/time data. The initiation of the rivet setting process is defined as is the ending of the process. Optionally, this can be defined by a peak strain that correlates to the breaking of the mandrel. The total time of the rivet setting event is determined and compared with a predetermined desired value. In addition, the system can utilize the mandrel breaking load to determine whether it falls within a predetermined tolerance band around a predetermined strain value indicative of the breaking of the mandrel.

To form the example strain/time data or pressure/time data, a statistically significant number of training measured signals are received and combined to form a representative curve. A tolerance band is defined with respect to the representative curve which is indicative a predetermined level of quality of the joint.

When the system is configured to monitor the supply pressure of the portion of the rivet setting process, the system applies a scaling factor, which is a function of the supply pressure to at least one of the strain, pressure or time data. In this regard, a series of functions are defined which relate to the varying supply pressures. These functions transform the strain versus time data into a series of transformed strain or pressure versus time data. Obviously, it is equally possible to transform either the example time versus strain or pressure data or the tolerance band in response to changes in the supply pressure, prior to the analysis to determine if the rivet set is acceptable.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

While various embodiments have been disclosed, it will be appreciated that other configurations may be employed within the spirit of the present invention. For example, the spindle and punch holder may be integrated into a single part. Similarly, the nose piece and clamp can be incorporated into a single or additional parts. Belleville springs may be readily substituted for compression springs. Additional numbers of reduction gears or planetary gear types can also be used if a gear reduction ratio is other than that disclosed herein; however, the gear types disclosed with the preferred embodiment of the present invention are considered to be most efficiently packaged relative to many other possible gear combinations. A variety of other sensors and sensor locations may be employed beyond those specifically disclosed as long as the disclosed functions are achieved.

It is further envisioned that various aspects of the present invention can be applied to other types of rivet machines, for example, the system can be used with self-piercing rivets, although various advantages of the present invention may not be realized. Further, the system can be used to set various types of fasteners, for example, multiple piece fasteners, solid fasteners, clinch fasteners or studs. Optionally, the following error conditions are detectible using the teachings of the present invention: A) changes in panel thickness, as indicated by a changes in timing and load; B) Misalignment between the fastener and the die as indicated by changes in maximum load; C) Improper die, as indicated by a changes in timing and load; D) Improper material hardness as indicated by a changes in load; E) Missing nut and/or panel as indicated by a changes in timing and load; F) Excessive tool wear as indicated by a changes in timing; G) Drift in press adjustment or setting as indicated by a changes in timing and load; and H) Improper or malformed nut or fastener as indicated by a changes in timing and load. The description of the invention is merely exemplary in nature and, thus, variations that do not depart from the gist of the invention are intended to be within the scope of the invention. Such variations are not to be regarded as a departure from the spirit and scope of the invention.

Additionally, analog or other digital types of electronic control systems, beyond microprocessors, can also be used with the riveting tool of the present invention. The electronic control units of the monitor and delivery module can be part of or separate from the main electronic control unit. It is also envisioned that more than two workpiece sheets can be joined by the present invention, and that the workpieces may be part of a microwave oven, refrigerator, industrial container or the like. While various materials and dimensions have been disclosed, it will be appreciated that other materials and dimensions may be readily employed. It is intended by the following claims to cover these and any other departures from the disclosed embodiments which fall within the true spirit of this invention.

What is claimed is:

1. A system for setting a self-piercing rivet, said system comprising:

a self-piercing rivet setting tool, said tool including a rivet engaging assembly, an axially movable member operatively coupled to said rivet for driving said rivet, a housing annularly disposed about said member;

a sensor configured to monitor strains with the tool during a rivet setting process and producing strain output signal related thereto; and a monitoring circuit, having circuitry to:

(a) receive a statistically significant series of training output signals from the sensor;

(b) align the series of training output signals to form a series of output/time predetermined value pairs; and (c) form an example set of output/time signals; and (d) defining tolerance range at about the example output time signals.

2. The system for setting a self-piercing rivet of claim 1 wherein said monitoring circuit further includes circuitry to:

produce from a series of strain output signals a measured strain-versus-time dataset;

scan said measured strain-versus-time dataset to determine a first last local maximum strain value;

scan said example strain-versus-time dataset to determine a second last local maximum strain value; and determine if the first last local maximum strain value and the second local maximum strain values are within one of a predetermined time tolerance band, or within a predetermined strain tolerance band.

3. The system of claim 1 wherein the strain sensor is configured to measure strain in an axial direction.

4. The system for setting a self-piercing rivet of claim 1 further including an indicator operatively connected to said measurement circuit for signaling to an operator the acceptability of the set based on said comparison of said strain output/predetermined value pairs.

5. The system of claim 1 wherein said sensor is a microstrain sensor.

6. The system of claim 1 wherein said monitoring circuit includes an integrator, a comparator connected with said integrator, and a programmable memory connected with said comparator.

7. The system of claim 1 wherein the housing comprises a c-shaped structure.

8. The system of claim 7 wherein the sensor is positioned on an exterior surface of the c-shaped structure.

9. The system according to claim 7 wherein the body defines a sensor mounting location, said sensor mounting location being at a point on the c-shaped structure which experiences deformation during a rivet setting event.

10. A rivet monitoring system comprising:

(a) an electrical control unit;

(b) an electric motor connected to the electrical control unit;

(c) a transmission operably driven by energization of the electric motor;

(d) a riveting punch operably advanced by the transmission; and (e) a sensor connected to the electrical control unit, the sensor being operable to sense strain induced by reaction forces induced by energization of the motor, wherein the electrical control unit, comprises a circuit configured to:

(a) receive a statistically significant number of series of training strain output signals from the sensor;

(b) align the series of training strain output signals to form a series of output/time predetermined value pairs; and (c) form an example set of output/time signals from the series of output/time predetermined value pairs; and (d) defining tolerance range at about the example set of output time signals.

11. The system of claim 10 further comprising a rivet operably driven by the punch.

12. The system of claim 10 further comprising a rivet feeder having an actuator connected to the electronic unit and a feed tube sensor connected to the electrical control unit, wherein the electrical control unit operably controls feeding of the rivet by the feeder during the riveting process and the feed tube sensor sends a signal to the electronic control unit indicative of the presence of the rivet.

13. The system of claim 12 wherein the transmission operably converts rotary motion of the electric motor to linear motion for moving the punch.

14. The system of claim 13 wherein the transmission includes a closed loop belt.

15. The system of claim 10 wherein the strain changes at least in part due to varying rivet setting performance.

16. The system of claim 10 wherein the sensor operably senses a strain within the c-shaped structure of the punch.

17. The system of claim 10 wherein the sensor operably senses a strain in the transmission.

18. The system of claim 10 wherein the electric control unit is a programmable computer.

19. A monitoring system comprising:

(a) a programmable monitoring unit;

(b) a riveting machine including a linear drive;

(c) a self piercing rivet operably set by the riveting machine when the control unit causes energization of the linear drive; and (d) a sensor configured to measure strains within a component of the riveting machine said strains being induced by a moment caused by energization of the linear drive, wherein the programmable monitoring circuit, comprises a circuitry configured to:

receive a statistically significant number of series of training strain output signals from the sensor;

align the series of training strain output signals to form a series of output/time predetermined value pairs; and form an example set of output/time signals from the series of output/time predetermined value pairs; and defining tolerance range at about the example set of output time signals.

20. The system of claim 19 wherein the monitoring unit compares a signal generated by the sensor to previously stored data.

21. The system of claim 19 wherein the sensor is attached to a c-shaped support of the riveting machine.

22. The system of claim 19 wherein the sensor is operable to indicate changes in strain during a rivet set process.

23. The system of claim 19 wherein the monitoring unit is operable to prevent operation of the linear drive.

24. The system of claim 19 further comprising an articulating robot, the riveting machine being attached to and positioned by the robot.

25. The system of claim 19 wherein the monitoring unit transmits an error signal if an undesired condition is present.

26. The system of claim 19 wherein the monitoring unit determines if a riveting characteristic is within a desired range.

* * * * *